US009724936B2

(12) United States Patent
Okazaki

(10) Patent No.: US 9,724,936 B2
(45) Date of Patent: Aug. 8, 2017

(54) LIQUID DISCHARGE APPARATUS AND METHOD OF CONVEYING MEDIUM

(71) Applicant: FUJIFILM Corporation, Tokyo (JP)

(72) Inventor: Takahide Okazaki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/397,110

(22) Filed: Jan. 3, 2017

(65) Prior Publication Data

US 2017/0113470 A1 Apr. 27, 2017

Related U.S. Application Data

(63) Continuation of application No. PCT/JP2015/068608, filed on Jun. 29, 2015.

(30) Foreign Application Priority Data

Jul. 25, 2014 (JP) ..... 2014-152090

(51) Int. Cl.
*B41J 11/00* (2006.01)
*B41J 13/22* (2006.01)
(Continued)

(52) U.S. Cl.
CPC ..... *B41J 11/0015* (2013.01); *B41J 11/002* (2013.01); *B41J 11/003* (2013.01);
(Continued)

(58) Field of Classification Search
CPC ... B41J 13/00; B41J 11/04; B41J 13/08; B41J 11/0015; B41J 11/002; B41J 11/003;
(Continued)

(56) References Cited

U.S. PATENT DOCUMENTS

2010/0110156 A1 5/2010 Hara et al.
2013/0027484 A1 1/2013 Fukui
2016/0152429 A1* 6/2016 La Vos ..... B65H 5/021 271/225

FOREIGN PATENT DOCUMENTS

JP H11-129457 A 5/1999
JP 2005-161814 A 6/2005
(Continued)

OTHER PUBLICATIONS

International Search Report issued in PCT/JP2015/068608; mailed Sep. 15, 2015.
Written Opinion issued in PCT/JP2015/068608; mailed Sep. 15, 2015.
International Preliminary Report on Patentability issued in PCT/JP2015/068608; issued Dec. 21, 2015.

*Primary Examiner* — Julian Huffman
(74) *Attorney, Agent, or Firm* — Studebaker & Brackett PC

(57) ABSTRACT

A liquid discharge apparatus includes: a liquid discharge head; a conveyer that supports and conveys a medium; a blower that is disposed on the upstream side of the liquid discharge head or the downstream side of the liquid discharge head and suppresses the change of the posture of the medium by sending the air to the medium; a temperature adjuster that is disposed on the side of the blower opposite to the liquid discharge head in the medium conveying direction and adjusts the temperature of an object to a temperature higher than the ambient temperature of the liquid discharge head or a temperature lower than the ambient temperature of the liquid discharge head; and a blast controller sends an operation stop command or an air reduction command to the blower at a blast region-pass timing at which the medium passes through a blast region of the blower.

20 Claims, 21 Drawing Sheets

(51) Int. Cl.

| | |
|---|---|
| ***B41J 13/08*** | (2006.01) |
| ***B41J 11/04*** | (2006.01) |
| ***B65H 29/54*** | (2006.01) |
| ***B41J 13/00*** | (2006.01) |

(52) U.S. Cl.
CPC ..... *B41J 11/007* (2013.01); *B41J 11/0085* (2013.01); *B41J 11/0095* (2013.01); *B41J 11/04* (2013.01); *B41J 13/00* (2013.01); *B41J 13/08* (2013.01); *B41J 13/226* (2013.01); *B65H 29/54* (2013.01)

(58) Field of Classification Search
CPC .... B41J 11/007; B41J 13/226; B41J 11/0085; B41J 11/0095; B65H 29/54
See application file for complete search history.

(56) References Cited

FOREIGN PATENT DOCUMENTS

| | | | |
|---|---|---|---|
| JP | 2006-103849 | A | 4/2006 |
| JP | 2009-292129 | A | 12/2009 |
| JP | 2010-102231 | A | 5/2010 |
| JP | 2010-110926 | A | 5/2010 |
| JP | 2010-158839 | A | 7/2010 |
| JP | 2011-168020 | A | 9/2011 |
| JP | 2012-131065 | A | 7/2012 |
| JP | 2013-028140 | A | 2/2013 |
| JP | 2014-117846 | A | 6/2014 |

* cited by examiner

TYPE OF SHEET: AAA CONVEYING CONDITION: EEE
DRYING PROCESSING CONDITION: CCC

TYPE OF SHEET: AAA CONVEYING CONDITION: DDD
DRYING PROCESSING CONDITION: CCC

TYPE OF SHEET: AAA CONVEYING CONDITION: BBB
DRYING PROCESSING CONDITION: CCC

| SHEET SIZE | $X_1$ | $X_2$ |
|---|---|---|
| A | $a_1$ | $a_2$ |
| B | $b_1$ | $b_2$ |
| C | $c_1$ | $c_2$ |
| | | |
| Z | $z_1$ | $z_2$ |

LIQUID DISCHARGE APPARATUS AND METHOD OF CONVEYING MEDIUM

CROSS REFERENCE TO RELATED APPLICATIONS

This application is a Continuation of PCT International Application No. PCT/JP2015/068608 filed on Jun. 29, 2015, which claims priority under 35 U.S.C §119(a) to Patent Application No. 2014-152090 filed in Japan on Jul. 25, 2014, all of which are hereby expressly incorporated by reference into the present application.

BACKGROUND OF THE INVENTION

1. Field of the Invention

The present invention relates to a liquid discharge apparatus and a method of conveying a medium, and more particularly, to a medium conveying technique of a liquid discharge apparatus that includes liquid discharge heads.

2. Description of the Related Art

An ink jet recording apparatus, which records a color image by using color ink, is known as a liquid discharge apparatus that includes liquid discharge heads using an ink jet system. The ink jet recording apparatus records a color image on a medium by discharging color ink to the medium from the liquid discharge heads using the ink jet system.

JP2006-103849A discloses an ink jet recording apparatus that includes a blower unit provided on the downstream side of liquid discharge heads in the conveying direction of a medium and performs processing for drying the medium by using the air sent from the blower unit.

Terms of "medium", "liquid discharge head", and "ink jet recording apparatus" correspond to terms of "recording medium", "ink head", and "image recording apparatus" of JP2006-103849A, respectively.

JP2011-168020A discloses an ink jet recording apparatus that includes a drawing section for recording an image on a medium and a drying processing section for performing processing for drying the medium on which the image is recorded. The ink jet recording apparatus disclosed in JP2011-168020A includes a blower unit, which is provided in the drying processing section at a position facing the outer peripheral surface of a drying cylinder for conveying the medium, and suppresses the occurrence of creases on the medium by using the air sent from the blower unit.

Terms of "medium", "drawing section", "drying processing section", "drying cylinder", and "blower unit" correspond to terms of "recording medium", "image recording section", "drying section", "drying drum", and "blower means" of JP2011-168020A, respectively.

JP2013-28140A discloses an ink jet recording apparatus using an impression cylinder conveying system. The ink jet recording apparatus disclosed in JP2013-28140A draws a color image on a medium by discharging color ink to the medium, which is conveyed by a drawing cylinder, from liquid discharge heads of a drawing section. The drawing cylinder includes grippers, which grip the front end of the medium, and conveys the medium while holding the medium on the outer peripheral surface thereof by suction.

Further, the ink jet recording apparatus disclosed in JP2013-28140A includes a drying section that is provided in the subsequent stage of the drawing section, and performs processing for drying the medium on which the color image is drawn. A chain gripper, which is provided with the grippers for gripping the front end of the medium, is applied to the conveyance of the medium in the drying section.

Terms of "medium", "drawing cylinder", "drawing section", "liquid discharge head", and "drying section" correspond to terms of "recording medium", "image recording drum", "image recording section", "ink jet head", and "ink drying processing section" of JP2013-28140A, respectively.

SUMMARY OF THE INVENTION

However, when the air sent from the blower unit flows into the drawing section of each of the ink jet recording apparatuses disclosed in JP2006-103849A and JP2011-168020A, dew condensation occurs on the discharge surfaces of the liquid discharge heads due to a difference between the temperature of the air sent from the blower unit and the temperature of the air, which is present around the discharge surfaces of the liquid discharge heads, and a difference between the humidity of the air sent from the blower unit and the humidity of the air that is present around the discharge surfaces of the liquid discharge heads.

That is, when high-temperature atmosphere continues to flow into the drawing cylinder, the temperature of the drawing cylinder rises. When the temperature of the drawing cylinder rises, a temperature difference is generated between the drawing cylinder and the discharge surfaces of the liquid discharge head. As a result, dew condensation occurs on the discharge surfaces of the liquid discharge heads.

Further, there is a concern that the rear end of the medium may fall on the side opposite to the outer peripheral surface of the drawing cylinder when the medium has passed from a suction-holding region of the drawing cylinder while the medium is delivered to the chain gripper of the drying processing section, which is disposed in the subsequent stage of the drawing section, from the drawing cylinder in the ink jet recording apparatus disclosed in JP2013-28140A.

It is possible to prevent the falling of the medium by sending the air to a delivery position of the medium between the drawing cylinder and the chain gripper so that the medium is positioned along the outer peripheral surface of the drawing cylinder. However, since the air, which is present around the drying processing section and of which the temperature and humidity are higher than those of the air present around the drawing section, is transported to the drawing section, dew condensation occurs on the discharge surfaces of the liquid discharge heads of the drawing section.

When dew condensation occurs on the discharge surfaces of the liquid discharge heads, there is a concern that the discharge performance of nozzle parts may change due to dew condensation. Further, there is a concern that the abnormal discharge of the nozzle parts may occur due to dew condensation.

The invention has been made in consideration of the above-mentioned circumstances, and an object of the invention is to provide a liquid discharge apparatus and a method of conveying a medium that suppress the occurrence of dew condensation on discharge surfaces of liquid discharge heads and achieve stable liquid discharge.

In order to achieve the above-mentioned object, a first aspect provides a liquid discharge apparatus comprising: a liquid discharge head that discharges liquid; a conveying section that supports and conveys a medium to which the liquid discharged from the liquid discharge head is to be applied; a blower unit that is disposed on the upstream side of the liquid discharge head in a medium conveying direction or the downstream side of the liquid discharge head in the medium conveying direction and suppresses the change of the posture of the medium by sending the air to the medium conveyed by the conveying section; a temperature adjusting section that is disposed on the downstream side of the blower unit in the medium conveying direction in a case in which the blower unit is disposed on the upstream side of the liquid discharge head in the medium conveying direction or is disposed on the upstream side of the blower unit in the medium conveying direction in a case in which the blower unit is disposed on the downstream side of the liquid discharge head in the medium conveying direction, and adjusts the temperature of an object, of which the temperature is to be adjusted, to a temperature higher than the ambient temperature of the liquid discharge head or a temperature lower than the ambient temperature of the liquid discharge head; and a blast control section that controls the operation of the blower unit. The blast control section sends an operation stop command, which stops an operation, or an air reduction command, which reduces the amount of the air to be sent, to the blower unit at a blast region-pass timing at which the medium to which the air is sent from the blower unit passes through a blast region of the blower unit.

According to the first aspect, the flowing of the air, which is present around the temperature adjusting section disposed on the side of the blower unit opposite to the liquid discharge head in the medium conveying direction, to the surrounding area of the liquid discharge head is suppressed. Accordingly, it is possible to prevent dew condensation that occurs on the discharge surface of the liquid discharge head due to a difference between the ambient temperature of the temperature adjusting section and the ambient temperature of the liquid discharge head and a difference between the humidity of the air present around the temperature adjusting section and the humidity of the air present around the liquid discharge head.

Further, since a change in the discharge characteristics of the liquid discharge head, which is caused by dew condensation occurring on the discharge surface of the liquid discharge head, is prevented, the abnormal discharge of the liquid discharge head is prevented. As a result, stable liquid discharge is achieved.

According to a second aspect, in the liquid discharge apparatus according to the first aspect, in a case in which a plurality of media are continuously conveyed, the blast control section applies a timing, at which the last medium of the plurality of media passes through the blast region of the blower unit, as the blast region-pass timing.

According to the second aspect, it is possible to stop the sending of the air from the blower unit or to reduce the amount of the air sent from the blower unit at an effective timing in a case in which media are continuously conveyed.

According to a third aspect, in the liquid discharge apparatus according to the first or second aspect, the blast control section applies a timing, at which a rear end of the medium to which the air is sent from the blower unit passes through the blast region, as the blast region-pass timing.

According to the third aspect, it is possible to stop the sending of the air from the blower unit or to reduce the amount of the air sent from the blower unit while reliably preventing the deformation of the medium, such as the falling of the medium and the turnover of the medium.

According to a fourth aspect, in the liquid discharge apparatus according to the first or second aspect, the blast control section applies a timing, at which a rear end of the medium to which the air is sent from the blower unit passes through a blast position of the blower unit, as the blast region-pass timing.

According to the fourth aspect, it is possible to stop the sending of the air from the blower unit or to reduce the amount of the air sent from the blower unit at an earlier timing.

According to a fifth aspect, in the liquid discharge apparatus according to the first or second aspect, the blast control section applies a timing, at which a part of the medium to which the air is sent from the blower unit passes through the blast region and the previously obtained shape of the medium during the conveyance of the medium is maintained, as the blast region-pass timing.

According to the fifth aspect, it is possible to stop the sending of the air from the blower unit or to reduce the amount of the air sent from the blower unit early while reliably preventing the deformation of a sheet, such as the falling of the medium and the turnover of the medium.

According to a sixth aspect, in the liquid discharge apparatus according to any one of the first to fifth aspects, the blast control section sends an operation start command to the blower unit at a blast region-reaching timing at which the medium to which the air is sent from the blower unit reaches the blast region of the blower unit.

According to the sixth aspect, deformation, such as falling or turnover, of the medium having passed through the blast region of the blower unit is prevented.

According to a seventh aspect, in the liquid discharge apparatus according to any one of the first to sixth aspects, in a case in which a plurality of media are continuously conveyed, the blast control section applies a timing, at which the first medium of the plurality of media reaches the blast region of the blower unit, as the blast region-pass timing.

According to the seventh aspect, it is possible to start the sending of the air from the blower unit at an effective timing in a case in which media are continuously conveyed.

According to an eighth aspect, in the liquid discharge apparatus according to the sixth or seventh aspect, the blast control section sends an operation start command to the blower unit at a blast region-reaching timing at which a front end of the medium to which the air is sent from the blower unit reaches the blast region of the blower unit.

According to the eighth aspect, since the air is sent to a medium at an earlier timing, it is possible to more reliably prevent the deformation of the medium.

According to a ninth aspect, in the liquid discharge apparatus according to the sixth or seventh aspect, the blast control section sends an operation start command to the blower unit at a blast region-reaching timing at which a rear end of the medium to which the air is sent from the blower unit reaches the blast region of the blower unit.

According to the ninth aspect, since the operation of the blower unit is started at a later timing while the deformation of a medium is prevented, the sending of the air, which is present around the temperature adjusting section, to the surrounding area of the discharge surface of the liquid discharge head is prevented by the air sent from the blower unit.

According to a tenth aspect, in the liquid discharge apparatus according to the sixth or seventh aspect, the blast control section sends an operation start command to the blower unit at a blast region-reaching timing that is a timing at which a part of the medium to which the air is sent from the blower unit reaches the blast region of the blower unit and the previously obtained shape of the medium during the conveyance of the medium is not maintained.

According to the tenth aspect, since the start of the operation of the blower unit is delayed as much as possible while the deformation of a medium is prevented, the sending of the air, which is present around the temperature adjusting section, to the surrounding area of the discharge surface of the liquid discharge head is prevented by the air sent from the blower unit.

According to an eleventh aspect, in the liquid discharge apparatus according to any one of the first to tenth aspects, the conveying section comprises a gripping part that grips one end of the medium conveyed by the conveying section to fix the medium.

According to the eleventh aspect, it is possible to prevent the deformation of a medium, such as the falling or turnover of a portion of a medium that is not gripped by the gripping part.

According to a twelfth aspect, in the liquid discharge apparatus according to any one of the first to eleventh aspects, the conveying section comprises a suction-fixing unit that sucks the surface of the medium, which is opposite to the surface of the medium to which the liquid discharged from the liquid discharge head is to be applied, to fix the medium.

According to the twelfth aspect, it is possible to prevent the deformation of a medium, such as the falling or turnover of a medium of which the suction performed by the suction-fixing unit is released.

According to a thirteenth aspect, in the liquid discharge apparatus according to any one of the first to twelfth aspects, the conveying section comprises a first conveying unit and a second conveying unit that is disposed on the downstream side of the first conveying unit in the conveying direction, and the blower unit is disposed at a position where a medium delivery region in which a medium is delivered to the second conveying unit from the first conveying unit is included in the blast region of the blower unit.

According to the thirteenth aspect, it is possible to prevent the deformation of a medium, such as the falling or turnover of a medium.

According to a fourteenth aspect, in the liquid discharge apparatus according to the thirteenth aspect, the liquid discharge head is disposed on a conveying path of a medium conveyed by the first conveying unit, and the temperature adjusting section is disposed at a position where the temperature adjusting section adjusts the temperature of the medium conveyed by the second conveying unit.

According to the fourteenth aspect, deformation, such as the falling or turnover, of a medium, which occurs when the medium is delivered to the second conveying unit from the first conveying unit, is prevented and the transport of the air, which is present around the temperature adjusting section disposed on the conveying path of a medium conveyed by the second conveying unit, to the surrounding area of the discharge surface of the liquid discharge head, which is disposed on the conveying path of the first conveying unit, is prevented.

According to a fifteenth aspect, in the liquid discharge apparatus according to the thirteenth or fourteenth aspect, the second conveying unit is disposed at a position where the conveying path of a medium of the second conveying unit is different from the conveying path of a medium of the first conveying unit in a vertical direction.

According to the fifteenth aspect, even in an aspect in which a medium is conveyed along the vertical direction where the falling of the medium easily occurs when the medium is conveyed to the second conveying unit from the first conveying unit, deformation, such as the falling or turnover of the medium, is prevented and the transport of the air, which is present around the temperature adjusting section, to the surrounding area of the discharge surface of the liquid discharge head is prevented.

According to a sixteenth aspect, in the liquid discharge apparatus according to any one of the thirteenth to fifteenth aspects, the first conveying unit is an impression cylinder that has a cylindrical shape, supports a medium by an outer peripheral surface thereof, and rotates and conveys the medium, comprises a first gripping part that grips one end of the medium to fix the medium, and includes a conveying path along which the medium is conveyed to the lower side in the vertical direction from the upper side in the vertical direction at a delivery position of the medium between itself and the second conveying unit.

According to the sixteenth aspect, the deformation of a medium, such as the falling or turnover of the medium, which occurs when the medium is delivered to the second conveying unit provided in the subsequent stage from the impression cylinder, is prevented.

According to a seventeenth aspect, in the liquid discharge apparatus according to any one of the thirteenth to sixteenth aspects, the second conveying unit comprises a second gripping part that grips at least one end of the medium conveyed by the second conveying unit to fix the medium, and the blower unit is disposed at a position where the blower unit sends the air to the first conveying unit from the second conveying unit.

According to the seventeenth aspect, the deformation of a medium, such as the falling or turnover of the medium, which occurs when the medium is delivered to the second conveying unit provided in the subsequent stage of the impression cylinder from the impression cylinder, is prevented.

According to an eighteenth aspect, in the liquid discharge apparatus according to any one of the thirteenth to seventeenth aspects, the temperature adjusting section includes a drying processing section that dries the medium to which the liquid discharged from the liquid discharge head is applied and performs processing for drying the medium conveyed by the second conveying unit.

According to the eighteenth aspect, the sending of high-temperature air, which is present around the drying processing section, to the surrounding area of the discharge surface of the liquid discharge head is prevented.

A nineteenth aspect provides a method of conveying a medium to which liquid discharged from a liquid discharge head, which discharges liquid, is to be applied. The method comprises: a blast step of sending the air to the medium to be conveyed from the upstream side of the liquid discharge head in a medium conveying direction or the downstream side of the liquid discharge head in the medium conveying direction; and a temperature adjusting step of adjusting the temperature of an object, of which the temperature is to be adjusted, to a temperature higher than the ambient temperature of the liquid discharge head or a temperature lower than the ambient temperature of the liquid discharge head on the downstream side of the sending of the air in the medium direction in a case in which the air is sent from the upstream side of the liquid discharge head in the medium conveying direction or on the upstream side of the sending of the air in the medium conveying direction in a case in which the air is sent from the downstream side of the liquid discharge head in the medium conveying direction. In the blast step, a blast stop command for stopping the sending of the air or an air reduction command for reducing the amount of the air to be sent is generated at a blast region-pass timing at which the medium to which the air is sent passes through a blast region.

In the nineteenth aspect, in a case in which a plurality of media are continuously conveyed, an aspect in which a timing, at which the last medium of the plurality of media passes through the blast region, is applied as the blast region-pass timing is preferable. Further, an aspect in which a timing at which the rear end of the medium to which the air is sent passes through the blast region is applied as the blast region-pass timing, an aspect in which a timing at which the rear end of the medium to which the air is sent passes through the blast position of the blower unit is applied as the blast region-pass timing, or an aspect in which a timing, at which a part of the medium to which the air is sent passes through the blast region and the previously obtained shape of the medium during the conveyance of the medium is maintained, is applied as the blast region-pass timing is preferable.

In the nineteenth aspect, an aspect in which a blast start command is sent at a blast region-reaching timing at which the medium to which the air is sent reaches the blast region is preferable. Further, in a case in which a plurality of media are continuously conveyed, an aspect in which a timing, at which the first medium of the plurality of media reaches the blast region, is applied as the blast region-pass timing is preferable.

In the nineteenth aspect, an aspect in which an operation start command is sent to the blower unit at the blast region-reaching timing at which the rear end of the medium to which the air is sent reaches the blast region, an aspect in which a blast start command is sent at the blast region-reaching timing at which the rear end of the medium to which the air is sent reaches the blast region of the blower unit, or an aspect in which a blast start command is sent at a blast region-reaching timing that is a timing at which a part of the medium to which the air is sent reaches the blast region and the previously obtained deformation of the medium does not occur is preferable.

In the nineteenth aspect, an aspect in which the medium is conveyed while one end of the medium is gripped, or an aspect in which the surface of the medium, which is opposite to the surface of the medium to which the liquid discharged from the liquid discharge head is to be applied, is sucked and the medium is fixed is preferable.

The nineteenth aspect can also be applied to an aspect which includes a first conveying step and a second conveying step of conveying a medium on the downstream side of a conveying path of the first conveying step in a conveying direction and in which the blast region includes a medium delivery region in which the medium is delivered to the second conveying step from the first conveying step.

The nineteenth aspect can also be applied to an aspect that includes a liquid discharge step of discharging liquid to a medium conveyed in the first conveying step and a temperature adjusting step of adjusting the temperature of a medium conveyed in the second conveying step.

The nineteenth aspect can also be applied to an aspect in which the conveying path of a medium of the second conveying step is different from the conveying path of a medium of the first conveying step in the vertical direction.

The nineteenth aspect can also be applied to an aspect in which the first conveying step rotates and conveys a medium while supporting the medium by an outer peripheral surface of an impression cylinder having a cylindrical shape and conveys the medium while gripping one end of the medium and the medium is delivered to the lower side in the vertical direction from the upper side in the vertical direction at a delivery position of the medium between the first conveying step and the second conveying step.

The nineteenth aspect can also be applied to an aspect in which the medium is conveyed while at least one end of the medium is gripped in the second conveying step and the air is sent to the conveying path of the first conveying step from the conveying path of the second conveying step.

The nineteenth aspect can also be applied to an aspect that includes a drying processing step of performing processing for drying the medium, which is conveyed in the second conveying step, as the temperature adjusting step.

According to the liquid discharge apparatus, the flowing of the air, which is present around the temperature adjusting section disposed on the side of the blower unit opposite to the liquid discharge head in the medium conveying direction, to the surrounding area of the liquid discharge head is suppressed. Accordingly, it is possible to prevent dew condensation that occurs on the discharge surface of the liquid discharge head due to a difference between the ambient temperature of the temperature adjusting section and the ambient temperature of the liquid discharge head and a difference between the humidity of the air present around the temperature adjusting section and the humidity of the air present around the liquid discharge head.

Further, since a change in the discharge characteristics of the liquid discharge head, which is caused by dew condensation occurring on the discharge surface of the liquid discharge head, is prevented, the abnormal discharge of the liquid discharge head is prevented. As a result, stable liquid discharge is achieved.

Figure 12:
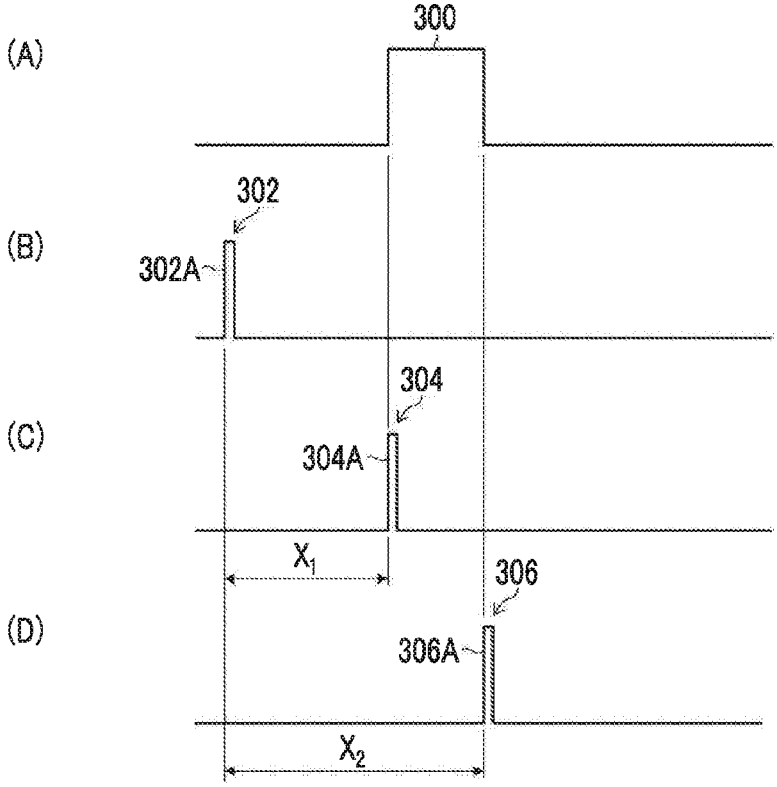

(A) of FIG. 12 is a schematic diagram showing the operating period of the blower unit, (B) of FIG. 12 is a schematic diagram showing an output signal of a sheet sensor, (C) of FIG. 12 is a schematic diagram showing a command signal that indicates the start of the operation of the blower unit, and (D) of FIG. 12 is a schematic diagram showing a command signal that indicates the stop of the operation of the blower unit.

Figure 13:
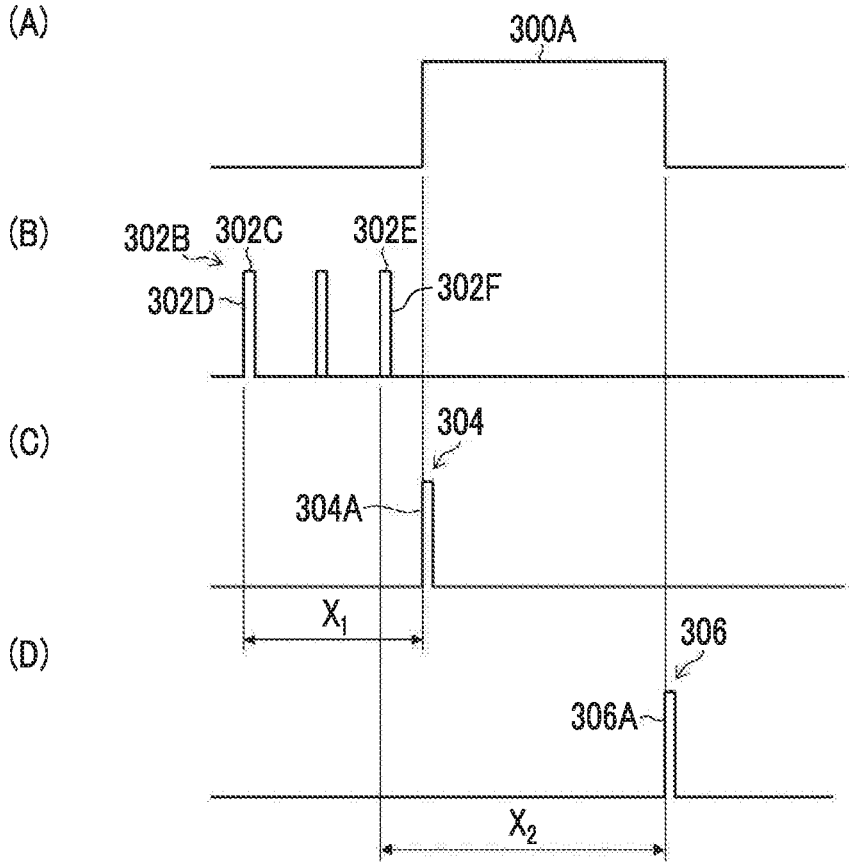

(A) of FIG. 13 is a schematic diagram showing the operating period of the blower unit during the continuous feeding of sheets, (B) of FIG. 13 is a schematic diagram showing an output signal of the sheet sensor during the continuous feeding of sheets, (C) of FIG. 13 is a schematic diagram showing a command signal that indicates the start of the operation of the blower unit during the continuous feeding of sheets, and (D) of FIG. 13 is a schematic diagram showing a command signal that indicates the stop of the operation of the blower unit during the continuous feeding of sheets.

Figure 14:
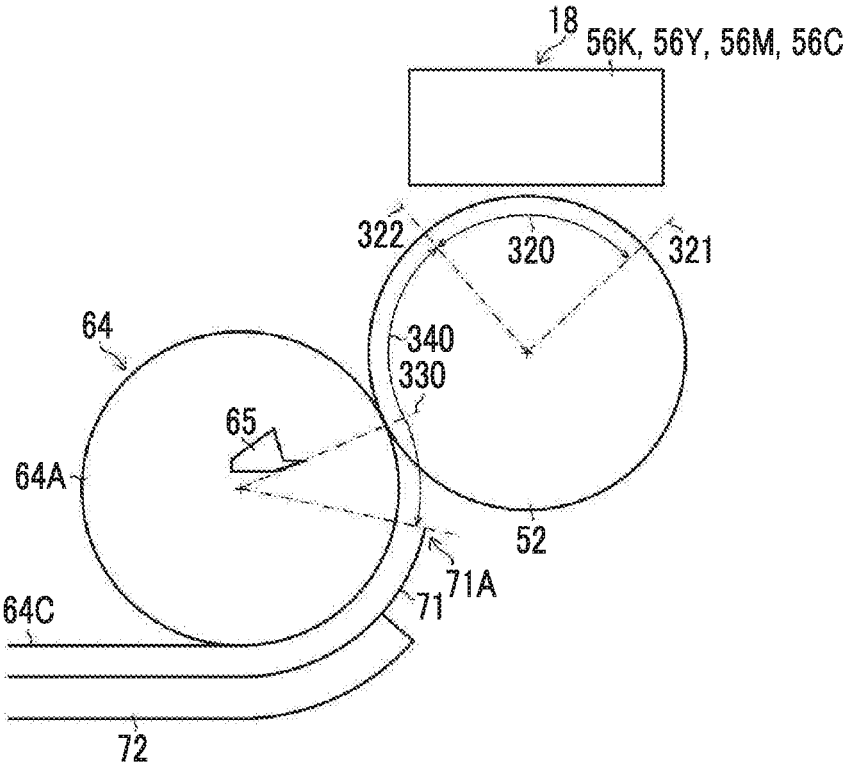

FIG. 14 is a view illustrating the timing of an operation start command for the blower unit and the timing of an operation stop command for the blower unit.

Figure 15A:
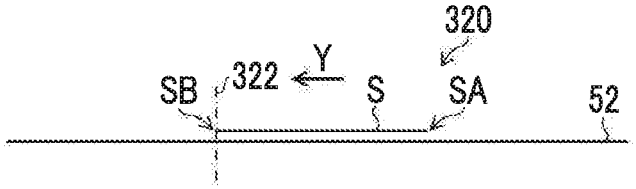
Figure 15B:
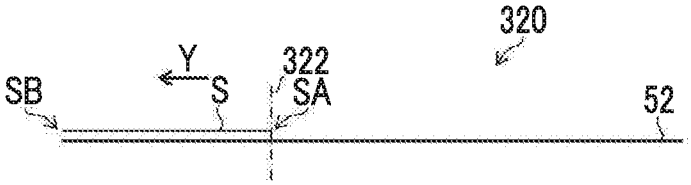
Figure 15C:
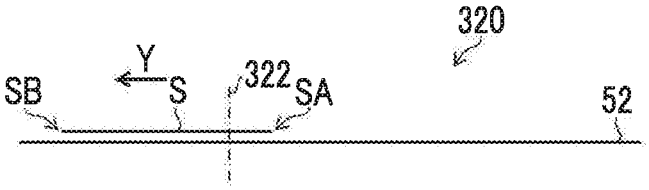

FIG. 15A is a schematic diagram showing a timing at which a front end of a sheet passes through a starting end of a blast region of the blower unit, FIG. 15B is a schematic diagram showing a timing at which a rear end of the sheet passes through the starting end of the blast region of the blower unit, and FIG. 15C is a schematic diagram showing a timing at which a part of the sheet passes through a terminus of the starting end of the blast region of the blower unit.

Figure 16:
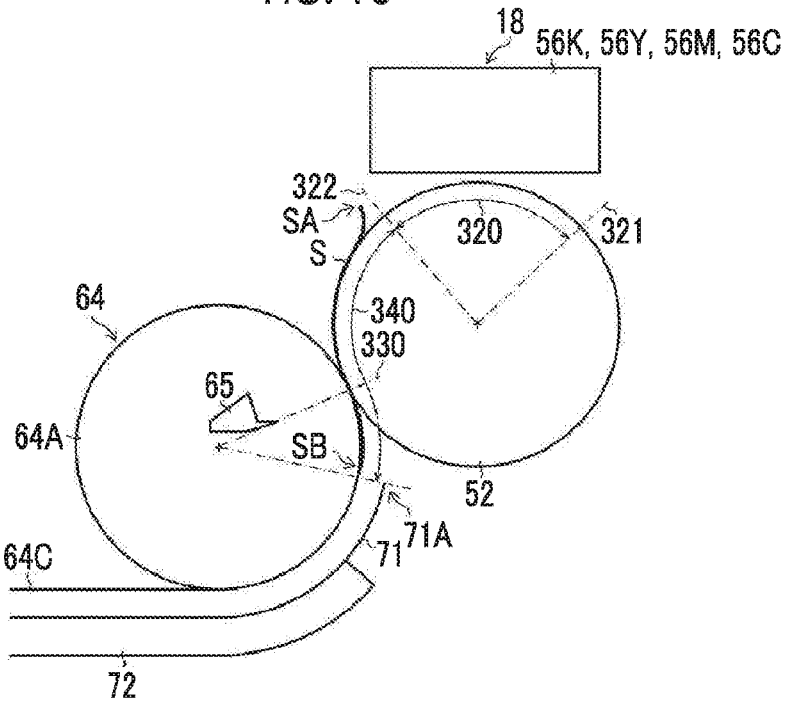

FIG. 16 is a schematic diagram showing an example of the falling of a sheet.

Figure 17:
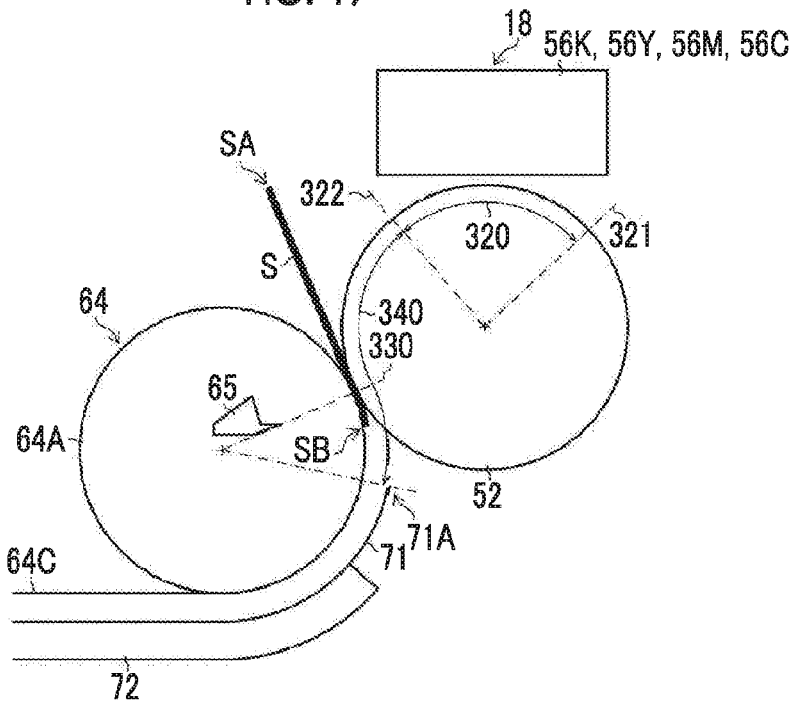

FIG. 17 is a schematic diagram showing another example of the falling of a sheet.

Figure 18A:
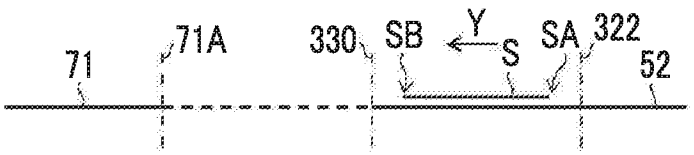
Figure 18B:
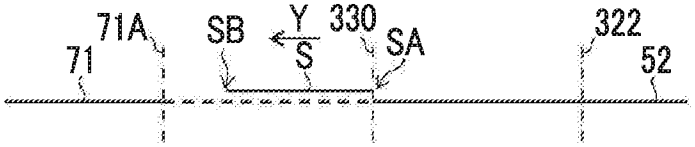
Figure 18C:
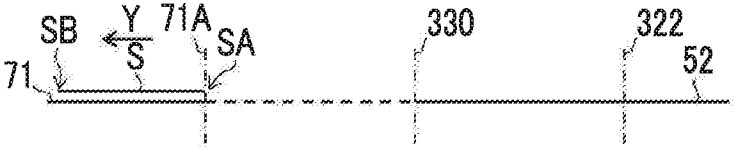

FIG. 18A is a schematic diagram showing a timing at which a part of a sheet passes through a starting end of a blast region of the blower unit, FIG. 18B is a schematic diagram showing a timing at which a rear end of the sheet passes through the blast position of the blower unit, and FIG. 18C is a schematic diagram showing a timing at which the rear end of the sheet passes through a starting end of a conveying guide.

Figure 19:
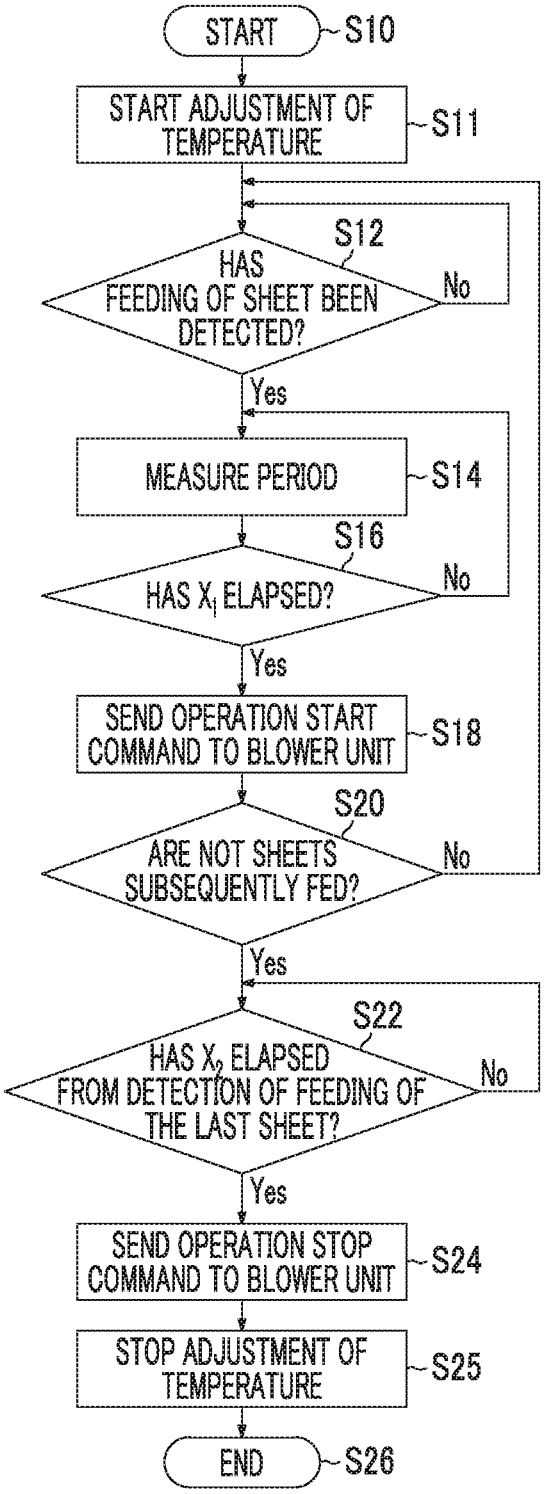

FIG. 19 is a flowchart illustrating the flow of the operation control of the blower unit.

Figures 20, 21:
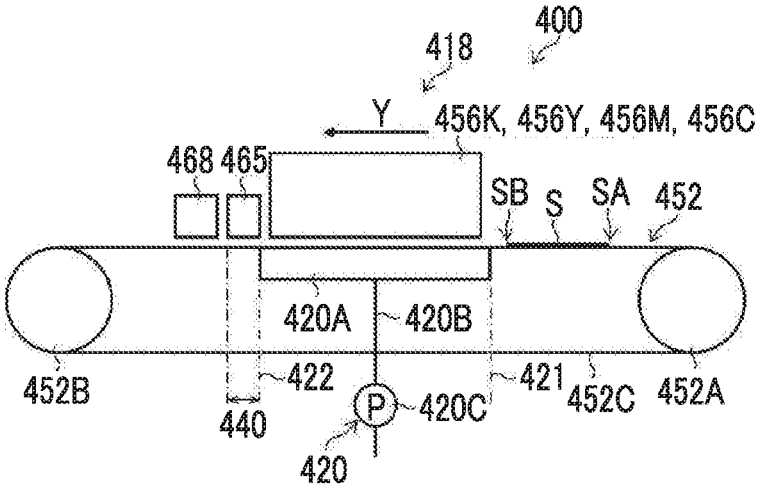

FIG. 20 is a diagram illustrating tables that are applied to the operation control of the blower unit.

FIG. 21 is a view showing the overall configuration of an ink jet recording apparatus according to a first modification example.

Figure 22:
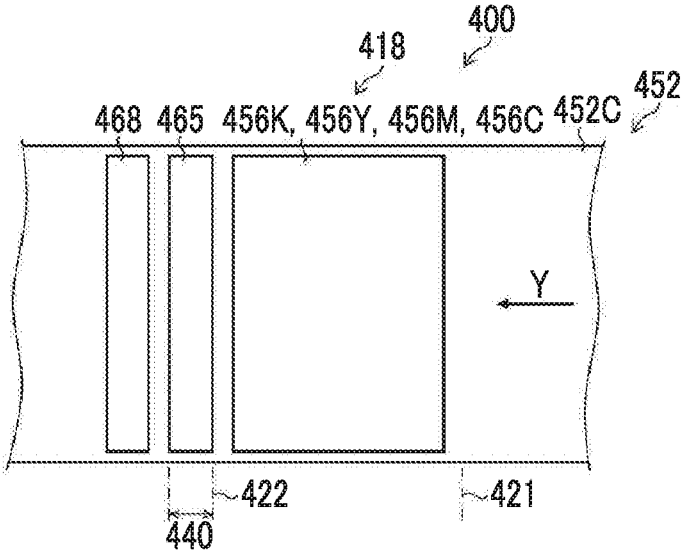

FIG. 22 is a plan view showing the arrangement of a blower unit and a temperature adjusting section of the ink jet recording apparatus shown in FIG. 21.

Figure 23:
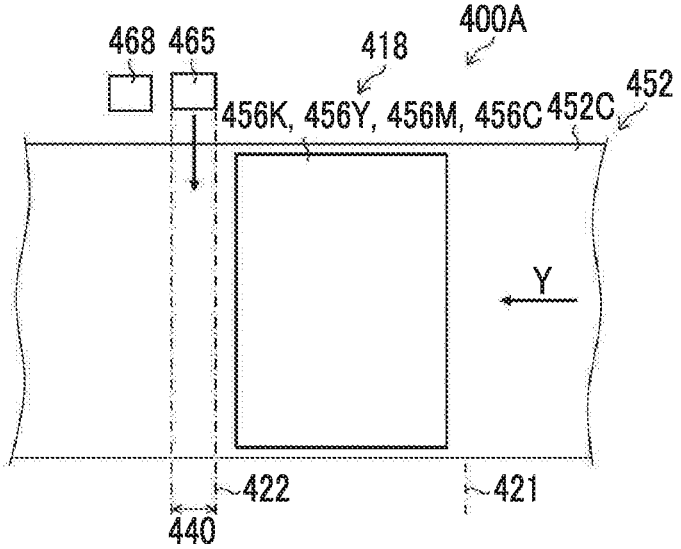

FIG. 23 is a plan view showing another example of the arrangement of the blower unit and the temperature adjusting section shown in FIG. 22.

Figure 24:
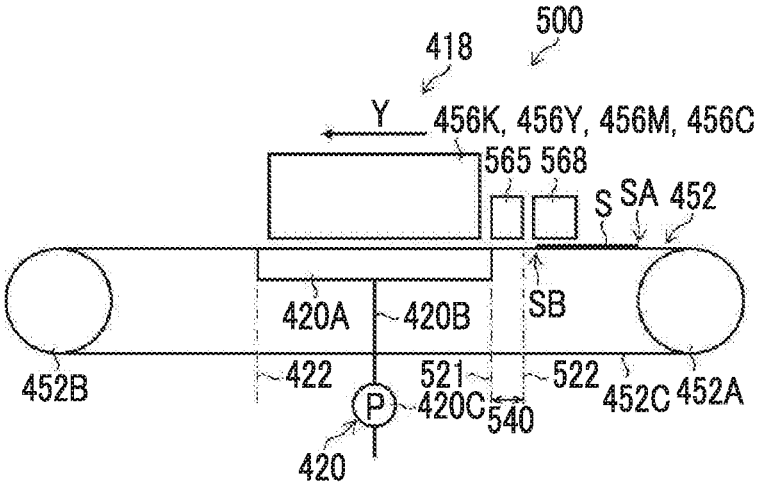

FIG. 24 is a view showing the overall configuration of an ink jet recording apparatus according to a second modification example.

Figure 25:
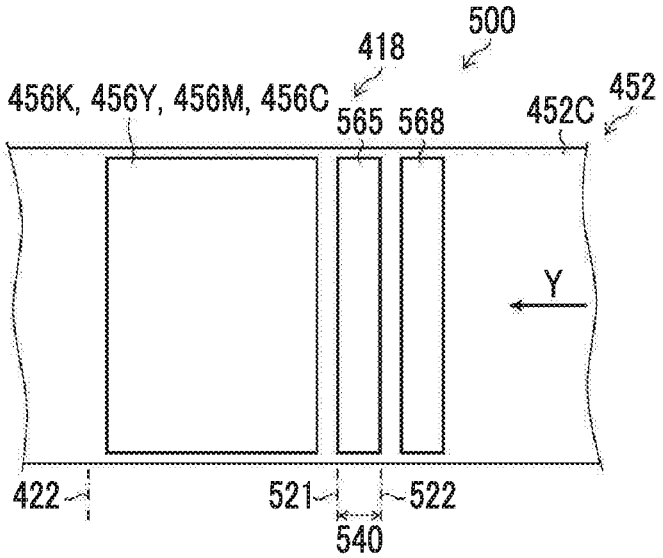

FIG. 25 is a plan view showing the arrangement of a blower unit and a temperature adjusting section of the ink jet recording apparatus shown in FIG. 24.

Figure 26:
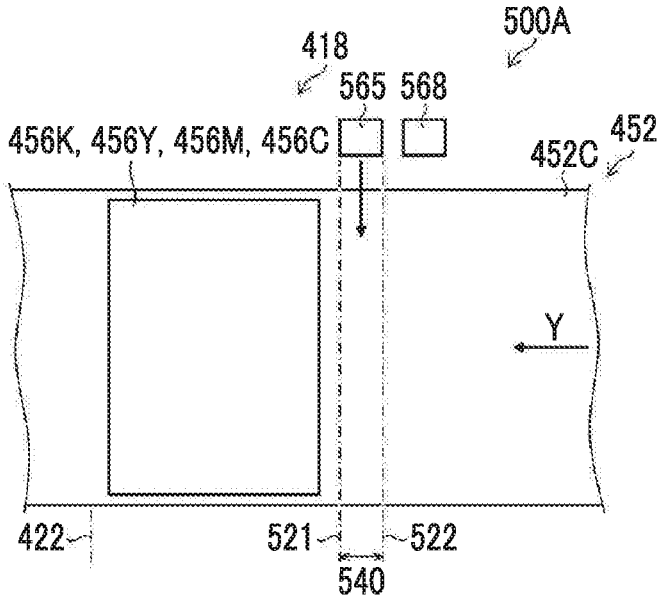

FIG. 26 is a plan view showing another example of the arrangement of the blower unit and the temperature adjusting section of the ink jet recording apparatus shown in FIG. 24.

DESCRIPTION OF THE PREFERRED EMBODIMENTS

A preferred embodiment of the invention will be described in detail below with reference to accompanying drawings.

[Overall Configuration of Ink Jet Recording Apparatus]

Figure 1:
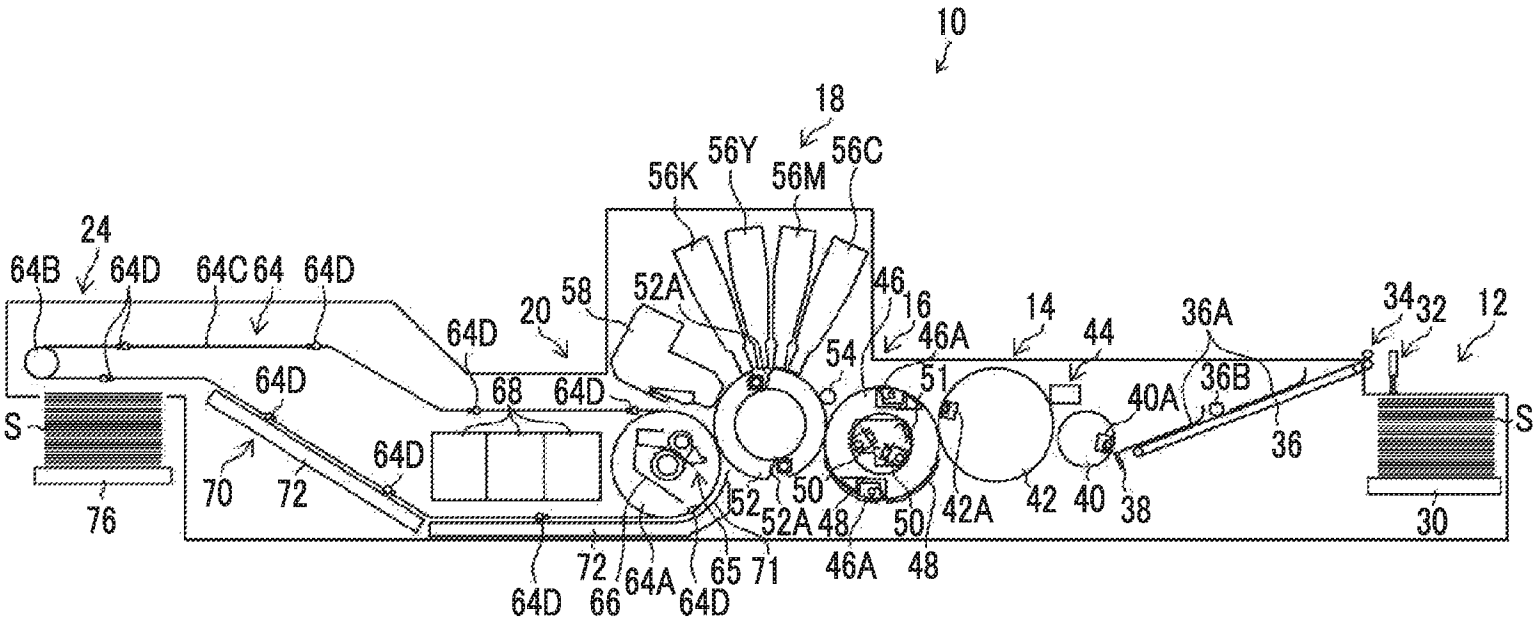
FIG. 1 is a view showing the overall configuration of an ink jet recording apparatus according to an embodiment of the invention.

FIG. 1 is a view showing the overall configuration of an ink jet recording apparatus according to an embodiment of the invention.

An ink jet recording apparatus 10 shown in FIG. 1 is an ink jet recording apparatus that draws an image on a sheet S with ink by an ink jet system. The ink jet recording apparatus 10 is an aspect of a liquid discharge apparatus that discharges liquid to a sheet S functioning as a medium.

The ink jet recording apparatus 10 mainly includes a sheet feeding section 12 that feeds a sheet S, a treatment liquid applying section 14, a treatment liquid drying processing section 16, a drawing section 18, an ink drying processing section 20, and a sheet discharge section 24. The treatment liquid applying section 14 applies treatment liquid to the sheet S fed from the sheet feeding section 12. The treatment liquid drying processing section 16 performs processing for drying the sheet S to which treatment liquid is applied by the treatment liquid applying section 14. The drawing section 18 records an image on the image recording of the sheet S, which has been subjected to drying processing by the treatment liquid drying processing section 16, with ink by an ink jet system. The ink drying processing section 20 performs processing for drying the sheet S on which the image is recorded by the drawing section 18. The sheet discharge section 24 discharges the sheet S that has been subjected to drying processing by the ink drying processing section 20.

The ink drying processing section 20 functions as a temperature adjusting section that adjusts the temperature of an object, of which the temperature is to be adjusted, to a temperature higher than the ambient temperature of the discharge surface of a liquid discharge head. The ambient temperature of the discharge surface is a temperature in the range where dew condensation on the discharge surface occurs.

[Sheet Feeding Section]

the sheet feeding section 12 mainly includes a sheet feeding stand 30, a sucker device 32, a pair of sheet feed rollers 34, a feeder board 36, a stopper 38, and a sheet feeding cylinder 40. The sheet feeding section 12 feeds sheets S, which are loaded on the sheet feeding stand 30, to the treatment liquid applying section 14 one by one.

The sheets S loaded on the sheet feeding stand 30 are sequentially lifted from the top thereof one by one by the sucker device 32, and are fed to the pair of sheet feed rollers 34. The sheets S, which are fed to the pair of sheet feed rollers 34, are placed on the feeder board 36 and are conveyed by the feeder board 36.

The sheet S is pushed against the conveying surface of the feeder board 36 by retainers 36A and a guide roller 36B, so that the irregularities of the sheet S are corrected. When the front end of the sheet S comes into contact with the stopper 38, the inclination of the sheet S is corrected. The sheet S, which is conveyed by the feeder board 36, is delivered to the sheet feeding cylinder 40.

While the front end portion of the sheet S, which is delivered to the sheet feeding cylinder 40, is gripped by a gripper 40A of the sheet feeding cylinder 40, the sheet S is conveyed to the treatment liquid applying section 14. The details of the gripper 40A are not shown.

The gripper 40A includes a plurality of claws that are arranged along the axial direction of the sheet feeding cylinder 40 and a claw stand that is disposed at a position facing the plurality of claws. The gripper 40 further includes a gripper shaft supporting the plurality of claws so that the plurality of claws can oscillate.

The plurality of claws are oscillated by the rotation of the gripper shaft of the gripper 40A, so that the gripper 40A is opened and closed. The arrangement of the plurality of claws is determined depending on the size of the sheet S.

[Treatment Liquid Applying Section]

The treatment liquid applying section 14 mainly includes a treatment liquid cylinder 42 that conveys a sheet S and a treatment liquid applying device 44 that applies predetermined treatment liquid to the image recording surface of the sheet S conveyed by the treatment liquid cylinder 42. The treatment liquid applying section 14 applies treatment liquid to the image recording surface of the sheet S.

The treatment liquid applied to the sheet S has a function to flocculate color materials, which are contained in the ink discharge to the sheet S by the drawing section 18 provided in the subsequent stage, or a function to insolubilize the color materials of the ink. Since the treatment liquid is applied to the sheet S and ink is then discharged to the sheet, high-quality printing can be performed without the occurrence of impact interference and the like even though a general-purpose sheet is used.

A term of "discharging" of this specification can be replaced with jetting or recording.

The sheet S, which is delivered from the sheet feeding cylinder 40 of the sheet feeding section 12, is delivered to the treatment liquid cylinder 42. The treatment liquid cylinder 42 grips the front end of the sheet S by a gripper 42A, and holds the sheet S on the outer peripheral surface by suction.

Since the same structure as the gripper 40A of the sheet feeding cylinder 40 can be applied to the gripper 42A, the description of the gripper 42A will be omitted.

When the treatment liquid cylinder 42 is rotated while the front end portion of the sheet S is gripped by the gripper 42A and the sheet S is held on the outer peripheral surface of the treatment liquid cylinder 42, the sheet S is conveyed while being wound on the outer peripheral surface of the treatment liquid cylinder 42. Treatment liquid is applied to the sheet S, which is conveyed to the treatment liquid cylinder 42, from the treatment liquid applying device 44.

Coating using a coating roller, coating using a blade, or the like can be used as an example of the form of application. Discharge using an ink jet system, spraying using a spray system, or the like can be used as another example of the form of application.

[Treatment Liquid Drying Processing Section]

The treatment liquid drying processing section 16 mainly includes a treatment liquid drying processing cylinder 46, sheet conveying guides 48, and a treatment liquid drying processing unit 50. The treatment liquid drying processing section 16 performs processing for drying the sheet S to which treatment liquid is applied. The treatment liquid drying processing cylinder 46 conveys the sheet S. The sheet conveying guides 48 support the sheet S that is conveyed by the treatment liquid drying processing cylinder 46. The treatment liquid drying processing unit 50 dries the sheet S, which is conveyed by the treatment liquid drying processing cylinder 46, by blowing hot air to the sheet S.

A treatment liquid drying cylinder blower unit 51, which sends the air to the delivery position of the sheet S to be delivered to the treatment liquid drying processing cylinder 46 from the treatment liquid cylinder 42, is disposed in the treatment liquid drying processing cylinder 46.

The front end of the sheet S, which is delivered to the treatment liquid drying processing cylinder 46 from the treatment liquid cylinder 42 of the treatment liquid applying section 14, is gripped by a gripper 46A of the treatment liquid drying processing cylinder 46. Since the same structure as the gripper 40A of the sheet feeding cylinder 40 can be applied to the gripper 46A, the description of the gripper 46A will be omitted.

The surface of the sheet S opposite to the surface of the sheet S coated with treatment liquid is supported by the sheet conveying guides 48 in a state in which the surface of the sheet S coated with treatment liquid faces inside. When the treatment liquid drying processing cylinder 46 is rotated, the sheet S is conveyed while being wound on the outer peripheral surface of the treatment liquid drying processing cylinder 46.

Hot air is sent to the sheet S, which is conveyed by the treatment liquid drying processing cylinder 46, from the treatment liquid drying processing unit 50 disposed in the treatment liquid drying processing cylinder 46, so that the sheet S is subjected to drying processing. When the sheet S is subjected to drying processing, a solvent component contained in the treatment liquid applied to the sheet S is removed and a treatment liquid layer is formed on the surface of the sheet S to which the treatment liquid is applied.

[Image Recording Section]

The drawing section 18 mainly includes a drawing cylinder 52, a sheet pressing roller 54, liquid discharge heads 56C, 56M, 56Y, and 56K, and an in-line sensor 58. The drawing section 18 draws a color image on the sheet S by discharging ink droplets, which have colors of C, M, Y, and K, to the sheet S on which the treatment liquid layer is formed. C represents cyan, M represents magenta, Y represents yellow, K represents black. The drawing cylinder 52 functions as an impression cylinder that conveys the sheet S while rotating. The sheet pressing roller 54 makes the sheet S come into close contact with the outer peripheral surface of the drawing cylinder 52 by pressing the sheet S that is conveyed by the drawing cylinder 52. The liquid discharge heads 56C, 56M, 56Y, and 56K discharge ink droplets, which have colors of C, M, Y, and K, to the sheet S. The in-line sensor 58 reads an image that is drawn on the sheet S.

The liquid discharge heads 56C, 56M, 56Y, and 56K are arranged along the conveying path of the sheet S on the drawing cylinder 52 that functions as a first conveying unit.

Various systems, such as a piezoelectric system that discharges ink by using the deflection of a piezoelectric element and a thermal system that discharges ink by heating ink and generating a film boiling phenomenon, can be applied to the liquid discharge heads 56C, 56M, 56Y, and 56K applied to this embodiment.

Figure 3:
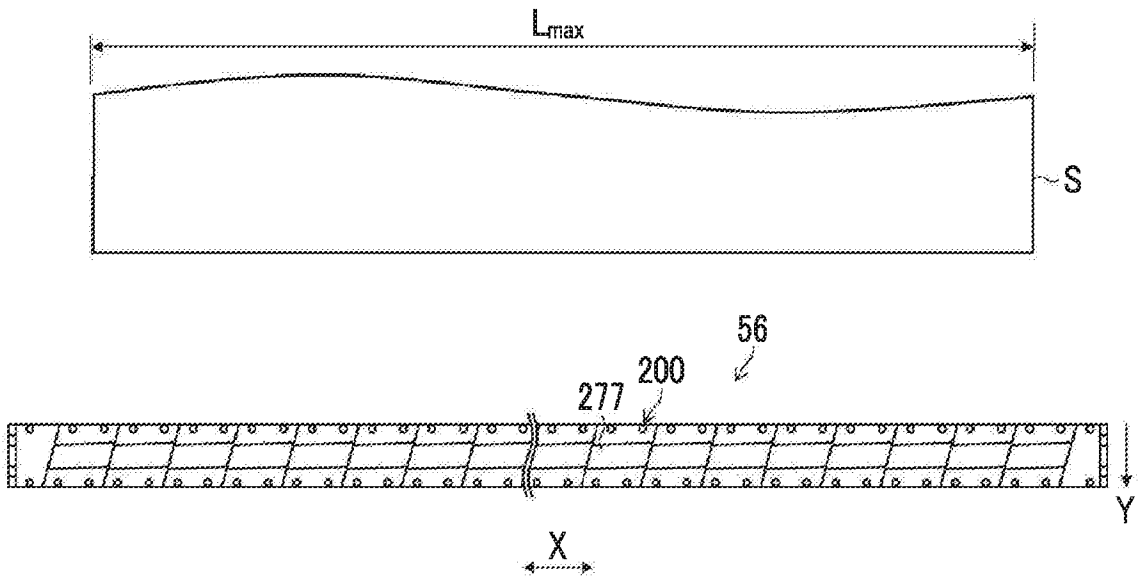
FIG. 3 is a plan perspective view of discharge surfaces that shows an example of the structure of a liquid discharge head shown in FIG. 1.

Further, a full-line type head denoted in FIG. 3 by reference numeral 56 is applied to each of the liquid discharge heads 56C, 56M, 56Y, and 56K applied to this embodiment. The details of the full-line type head will be described below.

The front end of the sheet S, which is delivered to the drawing cylinder 52 from the treatment liquid drying processing cylinder 46 of the treatment liquid drying processing section 16, is gripped by a gripper 52A of the drawing cylinder 52. Since the same structure as the gripper 42A of the treatment liquid cylinder 42 can be applied to the gripper 52A, the description of the gripper 52A will be omitted.

The gripper 52A functions as a gripping part or a first gripping part that grips one end of a medium to fix the medium.

When the sheet S passes below the sheet pressing roller 54, the sheet S comes into close contact with the outer peripheral surface of the drawing cylinder 52.

A plurality of suction holes are formed on the outer peripheral surface of the drawing cylinder 52. The suction holes communicate with a negative-pressure flow passage that is formed in the drawing cylinder 52. The negative-pressure flow passage is connected to a joint provided at the drawing cylinder 52, and is connected to a suction pump through the joint and a pipe connected to the joint. The suction holes, the negative-pressure flow passage, the joint, the pipe, and the suction pump will not be shown.

When the suction pump is operated, negative pressure is generated in the suction holes. Accordingly, the sheet S is held on the outer peripheral surface of the drawing cylinder 52 by suction. The suction holes, the negative-pressure flow passage, the joint, and the suction pump function as a suction-fixing unit.

When the sheet S, which is conveyed while being held on the outer peripheral surface of the drawing cylinder 52 by suction, pass through ink discharge regions positioned immediately below the liquid discharge heads 56C, 56M, 56Y, and 56K, ink droplets having colors of C, M, Y, and K are discharged to the sheet S from the liquid discharge heads 56C, 56M, 56Y, and 56K, respectively. As a result, a color image is drawn on the sheet S.

The ink, which is applied to the sheet S, reacts with the treatment liquid layer formed on the sheet S and is fixed to the sheet S without causing feathering, bleeding, and the like. A high-quality image is drawn on the sheet S in this way.

When the sheet S on which the image has been drawn by the liquid discharge heads 56C, 56M, 56Y, and 56K passes through the reading region of the in-line sensor 58, the drawn image is read. An image, which has a form called a test chart or a test pattern, is included in the image that is to be read by the in-line sensor 58.

An imaging device, which includes an imaging element, such as a CCD image sensor and generates electrical image data of an image to be read, is applied as the in-line sensor 58. CCD is the abbreviation for charge coupled device.

The reading of an image, which is performed by the in-line sensor 58, is performed as necessary, and the discharge states of the liquid discharge heads 56C, 56M, 56Y, and 56K are checked on the basis of the read data of the image.

The suction of the sheet S, which has passed through the reading region of the in-line sensor 58, performed by the drawing cylinder 52 is cancelled and the sheet S is delivered to the ink drying processing section 20.

[Ink Drying Processing Section]

The ink drying processing section 20 includes ink drying processing units 68 that perform processing for drying the sheet S conveyed by a chain gripper 64. The ink drying processing section 20 removes a liquid component, which remains on the sheet S on which the image has been drawn, by performing processing for drying the sheet S.

Examples of the structure of the ink drying processing unit 68 include a structure that includes a heat source, such as a halogen heater or an infrared heater, and a fan blowing the air, which is heated by the heat source, to the sheet S. The ink drying processing units 68 function as a temperature adjusting section that adjusts the temperature of the sheet S on which the image has been drawn, which is an object of which the temperature is to be adjusted, to a temperature higher than the ambient temperature of the liquid discharge heads 56C, 56M, 56Y, and 56K.

While the front end portion of the sheet S, which is delivered to the chain gripper 64 from the drawing cylinder 52 of the drawing section 18, is gripped by grippers 64D of the chain gripper 64, the sheet S is sent to the support region of a conveying guide 71.

The chain gripper 64 has a structure in which a pair of endless chains 64C are wound on a first sprocket 64A and a second sprocket 64B. The gripper 64D has a structure in which a plurality of claws are disposed between the pair of chains 64C and a claw stand is disposed at a position facing the claws.

The plurality of claws are supported by a gripper shaft of which both ends are supported by the pair of chains 64C so that the plurality of claws can oscillate. The plurality of claws are oscillated by the rotation of the gripper shaft, so that the gripper 64D is opened and closed.

A blower unit 65, which sends the air to a sheet delivery region in which the sheet S is delivered between the drawing cylinder 52 and the chain gripper 64 and generates the flow of the air along the peripheral surface of the drawing cylinder 52, is disposed in the first sprocket 64A. The sheet delivery region, which is a medium delivery region, is denoted in FIG. 7 by reference numeral 59 and is shown by a one-dot chain line. The blower unit 65 suppresses the change of the posture of a medium by sending the air to the sheet S to be conveyed. The details of the blower unit 65 will be described below.

Further, an isolation plate 66 for isolating the air present around the ink drying processing section 20 from the air present around the liquid discharge heads 56C, 56M, 56Y, and 56K is disposed in the first sprocket 64A.

The chain gripper 64 functions as a conveying section that conveys a medium, and functions as a second conveying unit. The gripper 64D functions as a gripping part or a second gripping part that grips one end of a medium to fix the medium. The ink drying processing units 68 function as a temperature adjusting section or a drying processing section, and are disposed at a position where the temperature of the sheet S conveyed by the chain gripper 64 functioning as the second conveying unit is adjusted.

The rear end portion of the sheet S, which is conveyed by the chain gripper 64, is guided by the conveying guide 71, and is sucked to a guide plate 72 that is disposed to be spaced apart from the chain gripper 64 by a constant distance. Accordingly, the lifting of the rear end of the sheet S is prevented.

The sheet S, which has been subjected to drying processing performed by the ink drying processing units 68, is sent to the sheet discharge section 24 via an inclined conveying path 70. A cooling processing section, which performs processing for cooling the sheet S passing through the inclined conveying path 70, may be provided. In the configuration that includes the cooling processing section, the cooling processing section functions as a temperature adjusting section that adjusts the temperature of an object, of which the temperature is to be adjusted, to a temperature lower than the ambient temperature of the discharge surface of a liquid discharge head.

[Sheet Discharge Section]

The sheet discharge section 24, which recovers the sheets S subjected to a series of image recording, includes a sheet discharge stand 76 that recovers the sheets S while making the sheets S be stacked thereon.

The chain gripper 64 releases the sheet S above the sheet discharge stand 76, and stacks the sheet S on the sheet discharge stand 76. The sheet discharge stand 76 recovers the sheet S, which is released from the chain gripper 64, while making the sheet S be stacked thereon.

The sheet discharge section 24 includes a sheet discharge stand elevator that lifts and lowers the sheet discharge stand 76. The sheet discharge stand elevator is not shown. The drive of the sheet discharge stand elevator is controlled while interlocking with an increase and a decrease in the number of the sheets S to be stacked on the sheet discharge stand 76. Accordingly, the sheet discharge stand elevator lifts and lowers the sheet discharge stand 76 so that the sheet S, which is positioned at the top, is always positioned at a constant height.

[Description of Control System]

Figure 2:
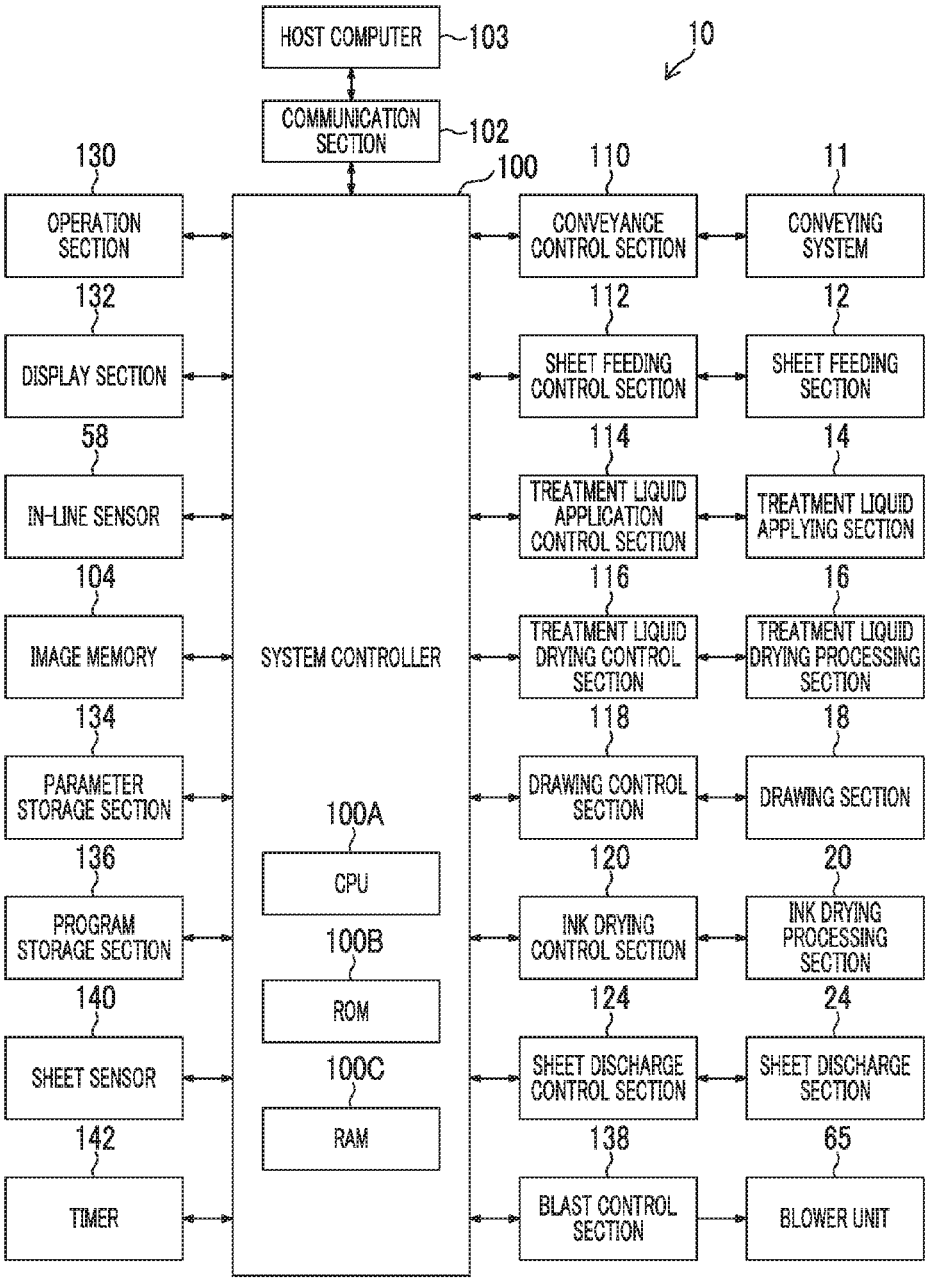
FIG. 2 is a block diagram showing the schematic configuration of a control system of the ink jet recording apparatus shown in FIG. 1.

FIG. 2 is a block diagram showing the schematic configuration of a control system of the ink jet recording apparatus 10 shown in FIG. 1.

As shown in FIG. 2, the ink jet recording apparatus 10 includes a system controller 100, a communication section 102, an image memory 104, a conveyance control section 110, a sheet feeding control section 112, a treatment liquid application control section 114, a treatment liquid drying control section 116, a drawing control section 118, an ink drying control section 120, a sheet discharge control section 124, an operation section 130, a display section 132, and the like.

The system controller 100 functions as a total control section that generally controls the respective sections of the ink jet recording apparatus 10, and functions as an arithmetic section that performs various kinds of arithmetic processing. A CPU 100A, a ROM 100B, and a RAM 100C are built in the system controller 100. CPU is the abbreviation for central processing unit, and ROM is the abbreviation for read only memory. RAM is the abbreviation for random access memory.

The system controller 100 also functions as a memory controller that controls the writing of data to memories, such as the ROM 100B, the RAM 100C, and the image memory 104, and the reading of data from these memories.

An aspect in which memories, such as the ROM 100B and the RAM 100C, are built in the system controller 100 has been illustrated in the FIG. 2, but the memories, such as the ROM 100B and the RAM 100C, may be provided outside the system controller 100.

The communication section 102 includes a necessary communication interface, and sends and receives data to and from a host computer 103 connected to the communication interface.

The image memory 104 functions as a temporary storage section for various data including image data, and data is read from and written in the image memory 104 through the system controller 100. Image data, which is taken from the host computer 103 through the communication section 102, is temporarily stored in the image memory 104.

The conveyance control section 110 controls the operation of a conveying system 11 for a sheet S of the ink jet recording apparatus 10. The treatment liquid cylinder 42, the treatment liquid drying processing cylinder 46, the drawing cylinder 52, and the chain gripper 64 illustrated in FIG. 1 are included in the conveying system 11.

The sheet feeding control section 112 illustrated in FIG. 2 controls an operation for starting the supply of a sheet S, an operation for stopping the supply of a sheet S, and the like by operating the sheet feeding section 12 in accordance with a command sent from the system controller 100.

The treatment liquid application control section 114 controls the amount of treatment liquid to be applied, the timing of the application of treatment liquid, and the like by operating the treatment liquid applying section 14 in accordance with a command sent from the system controller 100.

The treatment liquid drying control section 116 controls a drying temperature, the flow rate of drying gas, the timing of the injection of drying gas, and the like by operating the treatment liquid drying processing section 16 in accordance with a command sent from the system controller 100.

The drawing control section 118 controls the operation of the liquid discharge heads of the drawing section 18 in accordance with a command sent from the system controller 100. Respective units of the drawing control section 118 to be described below will not be shown in the drawings. Further, the liquid discharge heads are not shown in FIG. 2.

The drawing control section 118 includes an image processing unit that forms dot data from input image data, a waveform generating unit that generates the waveform of a drive voltage, a waveform storage unit that stores the waveform of the drive voltage, and a drive circuit that applies a drive voltage, which has a drive waveform corresponding to the dot data, to the liquid discharge heads.

Color separation processing for separating the input image data each color of RGB, color conversion processing for converting RGB into CMYK, correction processing, such as gamma correction and unevenness correction, and halftone processing for converting the gradation value of each pixel having each color into a gradation value smaller than an original gradation value are performed by the image processing unit.

Raster data, which is represented by a digital value in the range of 0 to 255, can be used as an example of the input image data. Dot data, which is obtained as the result of the halftone processing, may be a binary image and may be a multi-value image having three or more values.

A discharge timing and the amount of ink to be discharged at the position of each pixel are determined on the basis of the dot data generated through the processing performed by the image processing unit; a drive voltage corresponding to the discharge timing and the amount of ink to be discharged at the position of each pixel and a control signal determining the discharge timing at each pixel are generated; the drive voltage is applied to the liquid discharge head; and a dot is recorded at a recording position by ink droplets discharged from the liquid discharge head.

The ink drying control section 120 controls a drying temperature, the flow rate of drying gas, the timing of the injection of drying gas, and the like by operating the ink drying processing section 20 in accordance with a command sent from the system controller 100.

The sheet discharge control section 124 makes a sheet S be loaded on the sheet discharge stand 76 shown in FIG. 1 by operating the sheet discharge section 24 in accordance with a command sent from the system controller 100.

The in-line sensor 58 reads the image drawn on the sheet S, and sends the results of reading to an abnormal discharge analyzer (not shown) through the system controller 100. The abnormal discharge analyzer analyzes the presence or absence of the abnormal discharge of the liquid discharge head on the basis of a read signal of the in-line sensor 58.

An image, such as a test pattern or a test chart, is included in the image that is read by the in-line sensor 58.

The operation section 130 shown in FIG. 2 includes an operation member, such as operation buttons, a keyboard, or a touch panel, and sends operation information, which is input from the operation member, to the system controller 100. The system controller 100 performs various kinds of processing in accordance with the operation information that is sent from the operation section 130.

The display section 132 includes a display device, such as a liquid crystal panel, and makes information, such as various kinds of configuration information or abnormality information of the apparatus, be displayed on the display device in accordance with a command sent from the system controller 100.

As shown in FIG. 2, an output signal of the in-line sensor 58 is sent to the system controller 100. The system controller 100 stores the output signal of the in-line sensor 58 in a predetermined memory as read information of an image.

Various parameters, which are used in the ink jet recording apparatus 10, are stored in a parameter storage section 134. The various parameters, which are stored in the parameter storage section 134, are read through the system controller 100 and are set in the respective sections of the apparatus.

Programs, which are used in the respective sections of the ink jet recording apparatus 10, are stored in a program storage section 136. The various programs, which are stored in the program storage section 136, are read through the system controller 100 and are executed in the respective sections of the apparatus.

A blast control section 138 controls a blast start timing, a blast stop timing, the amount of the air sent per unit time, or the like by operating the blower unit 65 on the basis of a command signal that indicates an operation start command or an operation stop command sent from the system controller 100.

A sheet sensor 140 detects a feed-start timing for a sheet S. A detection signal, which indicates the feed-start timing for a sheet S obtained from the sheet sensor 140, is sent to the system controller 100.

A timer 142 measures a period, which has elapsed from the feed-start timing for a sheet, on the basis of a measurement start signal that is sent from the system controller 100 and indicates a sheet feeding timing for the sheet S.

The sheet sensor 140 and the timer 142, which are used to find out a blast region-pass timing at which the sheet S to which the air is sent from the blower unit 65 passes through a blast region of the blower unit 65, function as components of the blast control section.

[Structure of Liquid Discharge Head]

Next, the structure of the liquid discharge head will be described in detail.

[Overall Structure]

FIG. 3 is a view showing the structure of the liquid discharge heads 56C, 56M, 56Y, and 56K shown in FIG. 1, and is a plan perspective view of the discharge surfaces that discharge ink droplets. The same structure is applied to the liquid discharge heads 56C, 56M, 56Y, and 56K corresponding to the respective colors of CMYK. In a case in which the liquid discharge heads 56C, 56M, 56Y, and 56K do not need to be distinguished from one another, alphabets of the liquid discharge heads 56C, 56M, 56Y, and 56K will be omitted and the liquid discharge heads 56C, 56M, 56Y, and 56K will be described as the liquid discharge heads 56.

The liquid discharge head 56 shown in FIG. 3 has a structure in which a plurality of head modules 200 are connected to each other in an X direction, that is, the width direction of a sheet S orthogonal to a Y direction, that is, the conveying direction of a sheet S. The conveying direction of a sheet S is synonymous with a medium conveying direction.

The same structure can be applied to the plurality of head modules 200 of the liquid discharge head 56. Further, the head module 200 can be made to function as the liquid discharge head alone.

The liquid discharge head 56 shown in FIG. 3 has a structure in which the plurality of head modules 200 are arranged in a line along the X direction, and is a full-line type liquid discharge head in which a plurality of nozzle parts are arranged over the length corresponding to the overall width $L_{max}$ of a sheet S in the X direction. The nozzle parts are not shown in FIG. 3. The nozzle part is shown and denoted in FIG. 6 by reference numeral 281.

A plurality of nozzle openings are arranged on a discharge surface 277 of the head module 200 of the liquid discharge head 56. The nozzle openings are not shown in FIG. 3. The nozzle opening is shown and denoted in FIG. 5 by reference numeral 280. Further, the details of the arrangement of the plurality of nozzles and the arrangement of the plurality of nozzle openings will be described below.

The liquid discharge head 56 having a structure in which the plurality of head modules 200 are arranged in a line along the X direction has been illustrated in this embodiment, but the plurality of head modules 200 may be arranged in a zigzag pattern in the X direction and the plurality of head modules 200 may be integrated with each other.

The full-line type liquid discharge head 56 has been illustrated in this embodiment, but a serial system can be applied to this embodiment. The serial system performs the recording of an image corresponding to one time in the width direction of a sheet by a scanning operation using a short serial type liquid discharge head, which is shorter than the width of a sheet S, in the width direction of the sheet; conveys the sheet S by a constant distance in the conveying direction Y of the sheet S and performs the recording of an image in the width direction of the sheet S in the next region after the finish of the recording of an image corresponding to one time in the width direction of the sheet S; and repeats this operation to record an image on the entire surface of the sheet.

[Example of Structure of Liquid Discharge Head]

Figure 4:
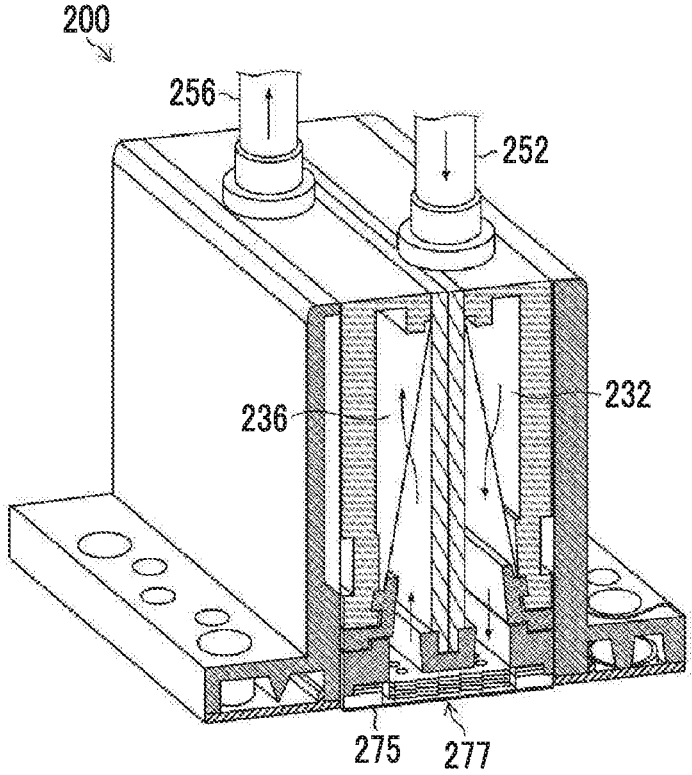
FIG. 4 is a cross-sectional view showing the internal structure of the liquid discharge head shown in FIG. 3.
Figure 5:
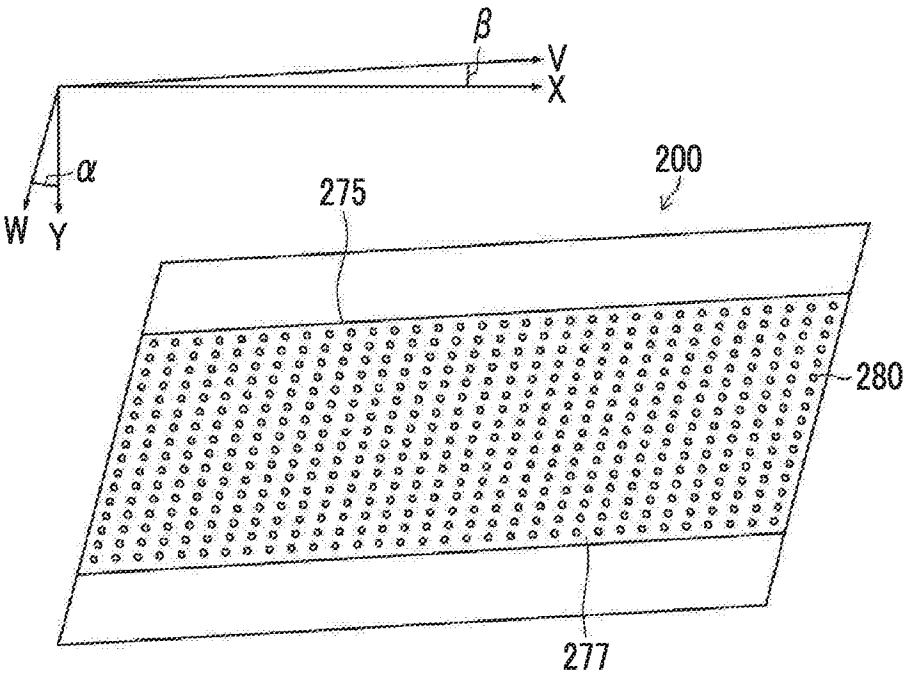
FIG. 5 is a plan perspective view of the discharge surface 277 of the head module 200 shown in FIG. 4.

FIG. 4 is a perspective view of the head module 200 that includes a partial cross-sectional view. FIG. 5 is a plan perspective view of the discharge surface 277 of the head module 200 shown in FIG. 4.

As shown in FIG. 4, the head module 200 includes an ink supply unit that includes an ink supply chamber 232 and an ink circulation chamber 236 provided on the side of a nozzle plate 275 opposite to the discharge surface 277, that is, on the upper side in FIG. 4.

The ink supply chamber 232 is connected to an ink tank (not shown) through a supply tube 252, and the ink circulation chamber 236 is connected to a recovery tank (not shown) through a circulation tube 256.

The nozzle openings 280 of which some are omitted are shown in FIG. 5, but the plurality of nozzle openings 280 are two-dimensionally arranged on the discharge surface 277 of the nozzle plate 275 of one head module 200.

That is, the head module 200 has a planar shape of a parallelogram that has an end face of a long side along a V direction inclined with respect to the X direction by an angle β and an end face of a short side along a W direction inclined with respect to the Y direction by an angle α, and the plurality of nozzle openings 280 are arranged in the form of a matrix in a row direction parallel to the V direction and a column direction parallel to the W direction.

The arrangement of the nozzle openings 280 is not limited to the aspect shown in FIG. 5, and the plurality of nozzle openings 280 may be arranged along a row direction parallel to the X direction and a column direction obliquely crossing the X direction.

That is, the matrix arrangement of the nozzle openings 280 is the arrangement of the nozzle openings 280 in which an interval between the nozzle openings 280 and a distance between the nozzles are uniform in a nozzle array projected in the X direction where the plurality of nozzle openings 280 are arranged along the X direction when the plurality of nozzle openings 280 are projected in the X direction.

In the nozzle array projected in the X direction, the nozzle openings 280 belonging to one head module 200 and the nozzle openings 280 belonging to the other head module 200 are mixed with each other at a connection portion between the adjacent head modules 200.

In a case in which each head module 200 does not have an error in the mounting position thereof, the nozzle openings 280 belonging to one head module 200 and the nozzle openings 280 belonging to the other head module 200 present at a connection region are arranged at the same positions. Accordingly, the arrangement of the nozzle openings 280 is uniform even at the connection region.

In the following description, the head modules 200 of the liquid discharge head 56 are regarded as head modules that are mounted without an error in the mounting positions thereof.

Figure 6:
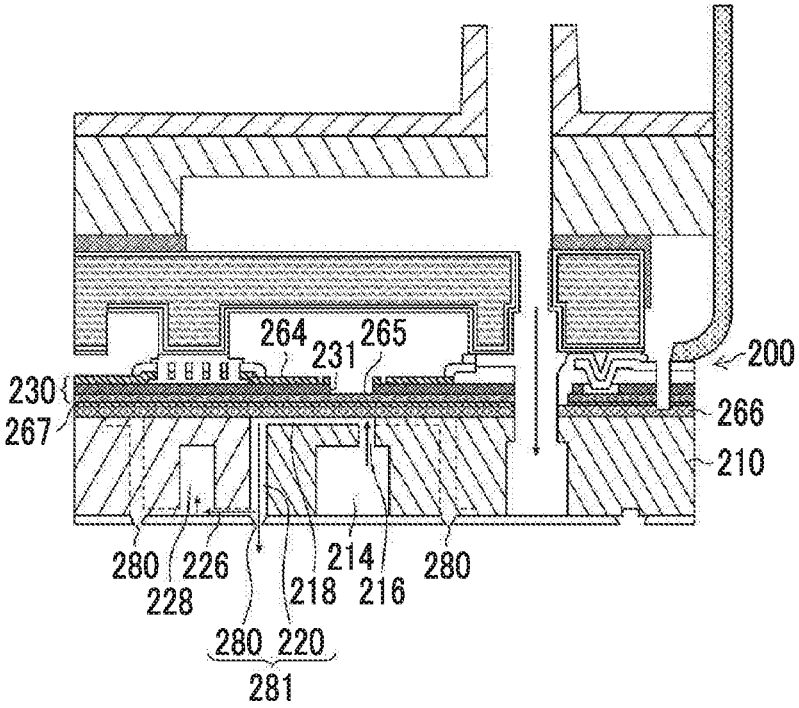
FIG. 6 is a cross-sectional view showing the internal structure of the liquid discharge head shown in FIG. 3.

FIG. 6 is a cross-sectional view showing the internal structure of the head module 200. Reference numeral 214 denotes an ink supply passage, reference numeral 218 denotes a pressure chamber, reference numeral 216 denotes an individual supply passage that connects each pressure chamber 218 to the ink supply passage 214, reference numeral 220 denotes a nozzle communication passage that is connected to the nozzle opening 280 from the pressure chamber 218, and reference numeral 226 denotes a circulation individual flow passage that connects the nozzle communication passage 220 to a circulation common flow passage 228. The pressure chamber 218 may be referred to as a liquid chamber.

A diaphragm 266 is provided on a flow passage structure 210 that forms these flow passage portions 214, 216, 218, 220, 226, and 228. A piezoelectric element 230, which has a laminated structure including a lower electrode 265, a piezoelectric layer 231, and an upper electrode 264, is provided on the diaphragm 266 with an adhesion layer 267 interposed therebetween. The lower electrode 265 may be referred to as a common electrode, and the upper electrode 264 may be referred to as an individual electrode.

The upper electrode 264 is formed of an individual electrode that is patterned so as to correspond to the shape of each pressure chamber 218, and each pressure chamber 218 is provided with the piezoelectric element 230.

Since the ink supply passage 214 is connected to the ink supply chamber 232 described in FIG. 4, ink is supplied to the pressure chamber 218 from the ink supply passage 214 through the individual supply passage 216. When a drive voltage is applied to the upper electrode 264 of the piezoelectric element 230 provided on the corresponding pressure chamber 218 in accordance with image data of an image to be recorded, the piezoelectric element 230 and the diaphragm 266 are deformed and the volume of the pressure chamber 218 is changed. As a result, ink is discharged from the nozzle openings 280 through the nozzle communication passage 220 due to a change in pressure that is caused by a change in the volume of the pressure chamber 218.

It is possible to discharge ink droplets from the nozzle openings 280 by controlling the drive of the piezoelectric element 230 corresponding to each nozzle opening 280 in accordance with dot arrangement data generated from the image data.

It is possible to record a desired image on a sheet S by controlling a timing, at which ink is discharged from each nozzle opening 280, in accordance with the conveying speed of the sheet S while conveying the sheet S in the Y direction at a constant speed.

Although not shown, the planar shape of the pressure chamber 218, which is provided so as to correspond to each nozzle opening 280, is a substantially square shape, an outlet through which ink flows out to the nozzle opening 280 is provided at one corner of both corners of the pressure chamber positioned on a diagonal line, and the individual supply passage 216, which is an inlet for ink to be supplied, is provided at the other corner thereof.

The shape of the pressure chamber is not limited to the square shape. Examples of the planar shape of the pressure chamber may include various shapes, such as quadrangular shapes, such as a rhombic shape and a rectangular shape, other polygonal shapes, such as a pentagonal shape and a hexagonal shape, a circular shape, and an oval shape.

A circulation outlet (not shown) is formed at the nozzle part 281, which includes the nozzle opening 280 and the nozzle communication passage 220, and the nozzle part 281 communicates with the circulation individual flow passage 226 through the circulation outlet.

Ink, which is not used for discharge, of the ink of the nozzle part 281 is recovered to the circulation common flow passage 228 through the circulation individual flow passage 226.

Since the circulation common flow passage 228 is connected to the ink circulation chamber 236 described in FIG. 4, ink is always recovered to the circulation common flow passage 228 through the circulation individual flow passage 226. Accordingly, the thickening of ink of the nozzle part is prevented when the ink is not discharged.

A scope to which the invention is applied is not limited to the structure shown in FIGS. 3 to 6. The nozzle openings 280 and the nozzle parts 281 may be arranged in a line in the width direction of a sheet S and may be disposed in two lines in a zigzag pattern.

Examples of the above-mentioned liquid discharge head 56 include a structure in which seventeen head modules 200 are arranged in a line along the X direction. Further, examples of the head module 200 include a structure that includes 2048 nozzle parts.

The piezoelectric elements 230, which are individually separated from each other so as to correspond to the respective nozzle parts 281, have been illustrated in FIG. 6 as an example of the piezoelectric elements. Naturally, a structure in which a piezoelectric layer 231 is integrally formed on the plurality of nozzle parts 281, individual electrodes are formed so as to correspond to the respective nozzle parts 281, and an active region is formed for each nozzle part 281 may be applied.

A thermal system, which includes a heater provided in the pressure chamber 218 as a pressure generating element instead of the piezoelectric element, makes the heater generate heat by applying a drive voltage to the heater, and discharges ink present in the pressure chamber 218 from the nozzle openings 280 by using a film boiling phenomenon, may be applied.

[Detailed Description of Structure of Blower Unit]

Figure 7:
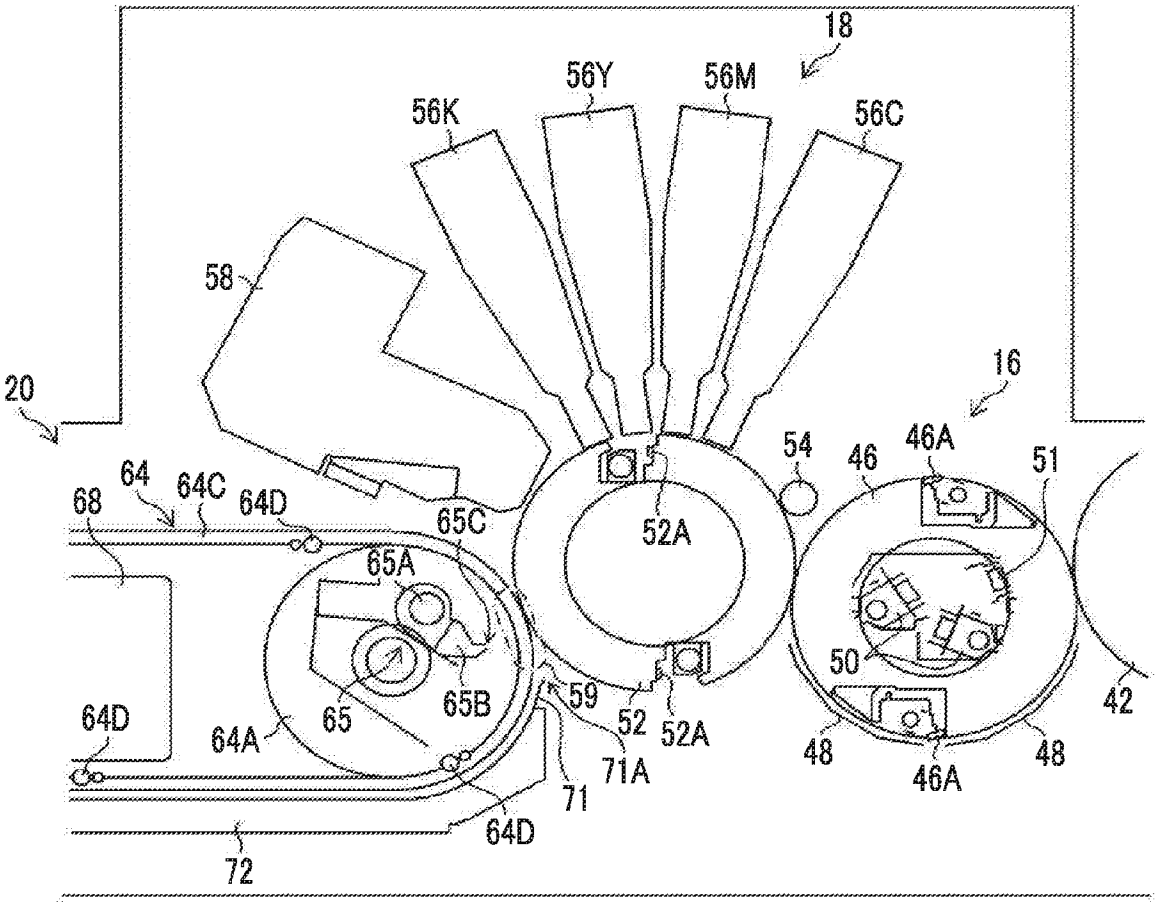
FIG. 7 is an enlarged view of FIG. 1 that shows the disposition of a blower unit.

FIG. 7 is an enlarged view of FIG. 1 that shows the disposition of the blower unit 65. In FIG. 7, the same components as those of FIG. 1 are denoted by the same reference numerals as those of FIG. 1 and the description thereof will be appropriately omitted.

The position of a rotation axis of the drawing cylinder 52, which is shown in FIG. 7, in a vertical direction and the vertical direction of a rotation axis of the first sprocket 64A of the chain gripper 64 are shifted to each other. Specifically, the position of the rotation axis of the drawing cylinder 52 in the vertical direction is set to a position higher than the vertical direction of the rotation axis of the first sprocket 64A. That is, in the vertical direction, the conveying path of a sheet S, which is provided on the upstream side in the conveying direction Y of the sheet S, is disposed on the upper side in the vertical direction that is a relatively high position, and the conveying path of the sheet S, which is provided on the downstream side in the conveying direction Y of the sheet S, is disposed on the lower side in the vertical direction that is a relatively lower position. The upstream side in the conveying direction Y of the sheet S is synonymous with the upstream side in the medium conveying direction, and the downstream side in the conveying direction Y of the sheet S is synonymous with the downstream side in the medium conveying direction.

Further, the position of the drawing cylinder 52 overlaps the chain gripper 64 in a horizontal direction. That is, a distance between the rotation axis of the drawing cylinder 52 and a rotation axis of the chain gripper 64 in the horizontal direction is smaller than the sum of the radius of the drawing cylinder 52 and the radius of the first sprocket 64A in the horizontal direction.

In this way, in a case in which a difference in height in the vertical direction is formed between means provided on the upstream side in the conveying direction Y of the sheet S and conveying the sheet S and means provided on the downstream side in the conveying direction Y of the sheet S and conveying the sheet S (between these means between which the sheet S is delivered), and a case in which means provided on the upstream side in the conveying direction Y of the sheet S and conveying the sheet S and means provided on the downstream side in the conveying direction Y of the sheet S and conveying the sheet S are disposed at positions where the means overlap each other in the horizontal direction, there is a possibility that the falling of the sheet S may occur when the sheet S is delivered.

The blower unit 65 shown in FIG. 7 sends the air to the sheet delivery region 59 between the drawing cylinder 52 and the chain gripper 64 and generates the flow of the air along the peripheral surface of the drawing cylinder 52. The sheet delivery region 59 is shown by a one-dot chain line. When the sheet S is delivered to the chain gripper 64, the falling of the sheet S, of which the holding performed by the suction of the drawing cylinder 52 is released, is prevented by the air sent from the blower unit 65.

the sheet S, of which the holding performed by the suction of the drawing cylinder 52 is released, includes a sheet S that has passed through a sheet suction region on which the suction of the drawing cylinder 52 acts, or a sheet S of which the holding performed by the suction of the drawing cylinder 52 is released since the sheet S is positioned in the sheet suction region of the drawing cylinder 52 but the restoring force of the sheet S bent along the peripheral surface of the drawing cylinder 52 exceeds a suction force generated by the drawing cylinder 52. The sheet suction region is shown and denoted in FIG. 14 by reference numeral 320.

The sheet delivery region 59 includes a position at which the front end portion of the sheet is gripped by both the gripper 52A of the drawing cylinder 52 and the grippers 64D of the chain gripper 64.

The blower unit 65 includes a blast generator 65A and a duct part 65B. The blast generator 65A has a cylindrical shape and includes an air blower not shown in FIG. 7. The air blower is shown and denoted in FIGS. 8 to 10 by reference numeral 65D. Examples of the air blower include a fan motor. Any one of an axial-flow fan motor, a mixed-flow fan motor, and a cross-flow fan motor may be applied to the fan motor.

The falling of the sheet S of which the holding performed by the suction of the drawing cylinder 52 is released is prevented by the appropriate control of the operation start timing, the operation stop timing, and the rotation speed of the air blower, the amount of the air sent from the air blower per unit time, blast pressure per unit area, and the like.

As long as the term, which means the amount of the air sent from the air blower, is not particularly denied, the term, which means the amount of the air sent from the air blower, means the amount of sent the air per unit time in the following description. Likewise, as long as the term, which means the blast pressure of the air blower, is not particularly denied, the term, which means the blast pressure of the air blower, means blast pressure per unit area. The starting end of the conveying guide 71 is shown and denoted in FIG. 7 by reference numeral 71A.

Figure 8:
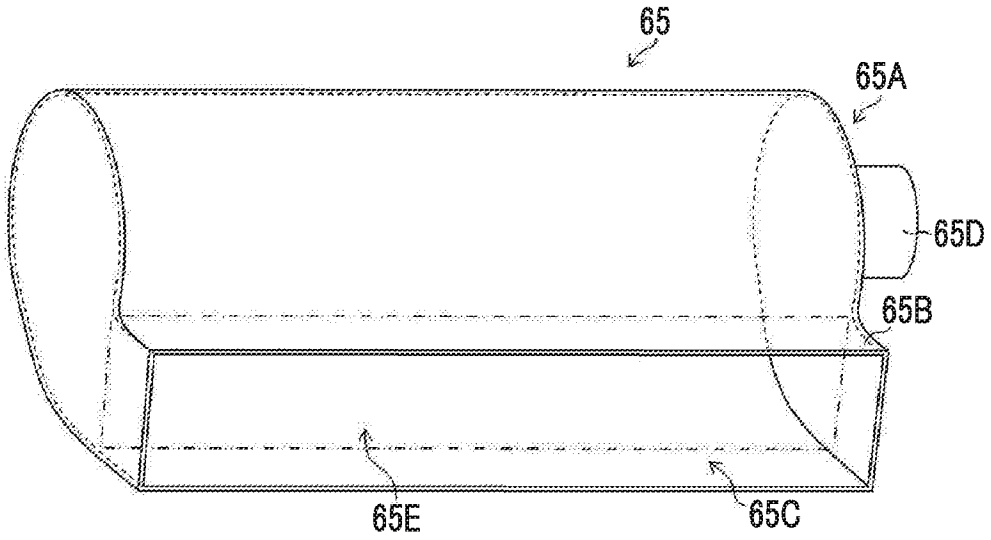
FIG. 8 is a perspective view showing an example of the structure of the blower unit.

FIG. 8 is a perspective view showing an example of the structure of the blower unit 65. The blast generator 65A shown in FIG. 8 has a structure in which the air blower 65D is disposed at one end of the blast generator 65A in a longitudinal direction and a base end of the duct part 65B in a lateral direction is joined.

The duct part 65B has the shape of a rectangular parallelepiped, and is provided with an air inlet 65E that is disposed at the base end of the rectangular parallelepiped in the lateral direction and an air outlet 65C that is provided at the tip thereof. The duct part 65B functions as a wind direction regulating member that regulates the direction of a blast generated from the blast generator 65A.

The air outlet 65C has a rectangular planar shape. The longitudinal direction of the air outlet 65C is parallel to the axial direction of the drawing cylinder 52 in a state in which the air outlet 65C of the blower unit 65 is disposed at a position facing the drawing cylinder 52.

In this specification, the term of "parallel" includes "substantially parallel" generating the same effects as the effects of "parallel" in a case in which two directions as objects cross each other.

The entire length of the air outlet 65C in the longitudinal direction corresponds to the maximum width of the sheet S. The maximum width of the sheet S is the entire length of the sheet S in the width direction of the sheet S that is orthogonal to the conveying direction Y of the sheet S. In a case in which plural types of sheets S are used, the maximum value of the entire length of each sheet in the width direction of each sheet is the maximum width of the sheet S.

In this specification, the term of "orthogonal" includes "substantially orthogonal" generating the same effects as the effects of "orthogonal" in a case in which two directions as objects cross each other at an angle smaller than 90° and a case in which two directions as objects cross each other at an angle larger than 90°.

An aspect in which an air outlet having the entire length shorter than the maximum width of the sheet S in the longitudinal direction is used for scanning along the width direction of the sheet S can be applied as an aspect in which the entire length of the air outlet 65C in the longitudinal direction corresponds to the maximum width of the sheet S.

The area of the air outlet 65C may be equal to or larger than the area of the air inlet 65E, and it is also preferable that the area of the air outlet 65C is smaller than the area of the air inlet 65E so that the cross-sectional area of a blast generated from the air blower 65D is reduced. FIG. 8 shows an example in which the area of the air outlet 65C is equal to the area of the air inlet 65E.

Figure 9:
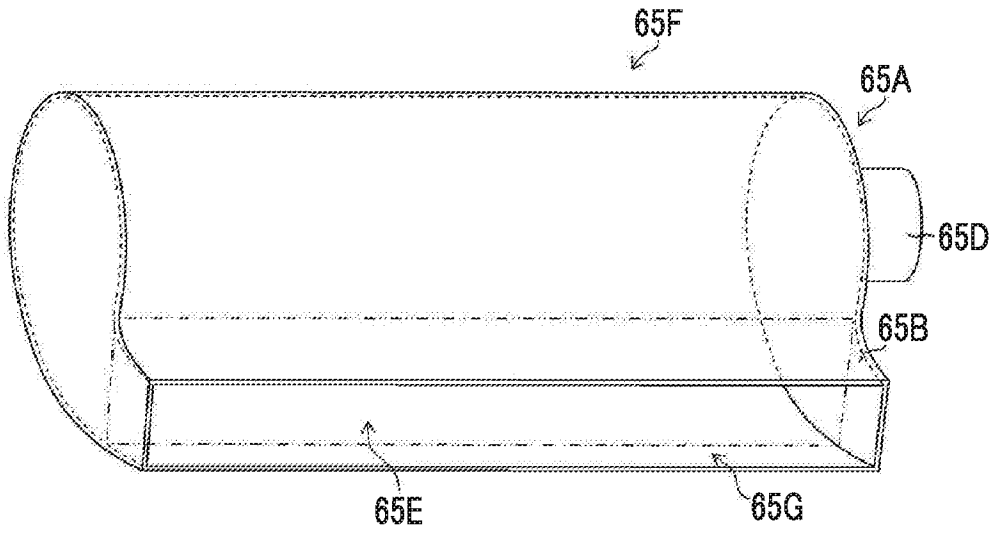
FIG. 9 is a perspective view showing another example of the structure of the blower unit.

FIG. 9 is a perspective view showing another example of the structure of the blower unit. In FIG. 9, the same components as those of FIG. 8 are denoted by the same reference numerals as those of FIG. 8 and the description thereof will be appropriately omitted. A blower unit 65F shown in FIG. 9 includes an air outlet 65G that has an area smaller than the area of the air inlet 65E.

When the cross-sectional area of a blast generated from the air blower 65D is reduced by the structure of the duct part 65B, the amount of sent air or blast pressure required to prevent the falling of the sheet S can be ensured while an increase in the rotation speed of the air blower 65D and an increase in power consumption are suppressed.

Figure 10:
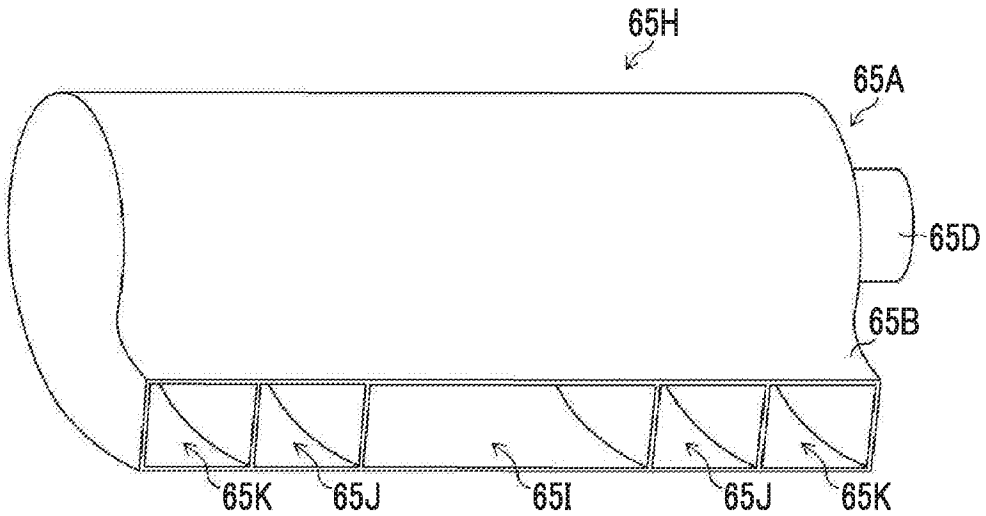
FIG. 10 is a perspective view showing still another example of the structure of the blower unit.

FIG. 10 is a perspective view showing another example of the structure of the blower unit. In FIG. 10, the same components as those of FIGS. 8 and 9 are denoted by the same reference numerals as those of FIGS. 8 and 9 and the description thereof will be appropriately omitted. A blower unit 65H shown in FIG. 10 has a structure in which a plurality of air outlets 651, 65J, and 65K are arranged along the longitudinal direction of the duct part 65B. An air inlet is not shown in FIG. 10.

The lengths of the air outlets 651, 65J, and 65K in the longitudinal direction of the duct part 65B correspond to sheets S having a plurality of sizes, respectively. It is possible to send the air, which is appropriate for the respective sheets S having a plurality of sizes, by individually controlling the air sent from the air outlets 651, 65J, and 65K.

Figure 11:
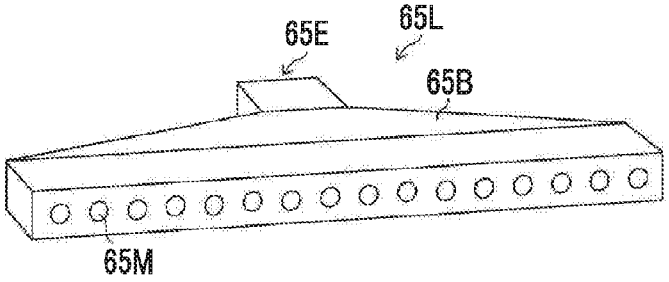
FIG. 11 is a perspective view showing still another example of the structure of the blower unit.

FIG. 11 is a perspective view showing another example of the structure of the blower unit. In FIG. 11, the same components as those of FIGS. 8 to 10 are denoted by the same reference numerals as those of FIGS. 8 to 10 and the description thereof will be appropriately omitted. The blast generator 65A shown in FIGS. 8 to 10 will be omitted in FIG. 11.

A blower unit 65L shown in FIG. 11 has a structure in which a plurality of blast nozzles 65M are arranged at the tip of the duct part 65B. The plurality of blast nozzles 65M are arranged along the longitudinal direction of the duct part 65B. A compressed air generator, which generates compressed air, such as a vacuum pump, can be applied as a blast generator of the blower unit 65L shown in FIG. 11.

The blower unit 65L shown in FIG. 11 has a structure in which the sum of the opening areas of the plurality of blast nozzles 65M is smaller than the opening area of the air inlet 65E.

FIG. 11 has shown an aspect in which the plurality of blast nozzles 65M are arranged along the longitudinal direction of the duct part 65B so as to correspond to the maximum width of a sheet S. However, an aspect in which a plurality of blast nozzles 65M are arranged along the longitudinal direction of the duct part 65B over a length shorter than the maximum width of a sheet S and the plurality of blast nozzles 65M are used for scanning along the width direction of the sheet S over the length corresponding to the maximum width of the sheet S may be applied.

[Description of Operation Control of Blower Unit]

Next, the operation control of the blower unit will be described in detail.

[Description of Operating Period of Blower Unit]

(A) to (D) of FIG. 12 are diagrams showing the operation control of the blower unit. The operation control of the blower unit to be described below can be applied to any of the blower unit 65 shown in FIG. 8, the blower unit 65F shown in FIG. 9, the blower unit 65H shown in FIG. 10, and the blower unit 65L shown in FIG. 11. The blower unit 65 shown in FIG. 8 will be described below.

(A) of FIG. 12 is a schematic diagram showing a blowing period 300 in which the blower unit 65 operates. A command signal 304, which indicates the start of an operation, is sent to the blower unit 65 when $X_1$ seconds has passed from a sheet feeding timing shown in (B) of FIG. 12 as shown in (C) of FIG. 12 and the blower unit 65 starts to operate. A command signal 306, which indicates the stop of an operation, is sent to the blower unit 65 when $X_2$ seconds has passed from the sheet feeding timing as shown in (D) of FIG. 12 and the blower unit 65 stops operating.

(B) of FIG. 12 is a schematic diagram showing an output signal of the sheet sensor 140 shown in FIG. 2. An output signal 302 of the sheet sensor 140 shown in (B) of FIG. 12 is a pulse signal that is output from the sheet sensor 140 when the front end of the sheet S reaches the detection region of the sheet sensor 140. A rising edge 302A of the output signal 302 indicates a sheet feeding timing.

The output signal 302 of the sheet sensor 140 is supplied to the timer 142 through the system controller 100 shown in FIG. 2. The timer 142 starts to measure a period, which has elapsed from the sheet feeding timing, at the timing of the rising edge 302A of the output signal of the sheet sensor 140. A value, which is measured by the timer 142, is periodically stored in a predetermined memory.

When the value measured by the timer 142 becomes $X_1$ seconds, the blast control section 138 sends the command signal 304, which indicates the start of an operation, to the blower unit 65. (C) of FIG. 12 is a schematic diagram showing the command signal 304 that is sent to the blower unit 65 from the blast control section 138 and indicates the start of the operation. The blower unit 65 starts to operate at the timing of a rising edge 304A of the command signal 304. The command signal 304, which is shown in Fig. (C) of 12 and indicates the start of the operation, is synonymous with a blast start command.

The air blower of the blower unit 65 may include an air blower that reaches a prescribed rotation speed when a predetermined period has elapsed from the input of the command signal 304.

When the value measured by the timer 142 becomes $X_2$ seconds, the blast control section 138 sends the command signal 306, which indicates the stop of an operation, to the blower unit 65. (D) of FIG. 12 is a schematic diagram showing the command signal 306 that is sent to the blower unit 65 from the blast control section 138 and indicates the stop of the operation. The blower unit 65 stops operating at the timing of a rising edge 306A of the command signal 306. The command signal, which is shown in (D) of FIG. 12 and indicates the stop of the operation, is synonymous with a blast start command.

The air blower of the blower unit 65 may include an air blower that decelerates gradually or stepwise from the input of the command signal 306 and stops when a predetermined period has elapsed from the input of the command signal 306.

(A) to (D) of FIG. 13 are diagrams showing the operation control of the blower unit in the case of continuous conveyance in which sheets are continuously fed. In (A) to (D) of FIG. 13, the same portions as those of (A) to (D) of FIG. 12 are denoted by the same reference numerals as those of (A) to (D) of FIG. 12 and the description thereof will be appropriately omitted.

Examples of a case in which sheets are continuously fed include a case in which a sheet feeding interval is shorter than a predetermined period. The predetermined period is determined from information, such as the length of a sheet S in the conveying direction Y and the conveying speed of a sheet S. A signal, which represents information about whether or not sheets are continuously fed, may be acquired from the outside to switch whether sheets are continuously fed.

(A) of FIG. 13 is a schematic diagram showing a blowing period 300A in which the blower unit 65 operates in a case in which sheets are continuously fed.

When sheets are continuously fed, the sheet sensor 140 continuously outputs an output signal 302B, which indicates a sheet feeding timing, as shown in (B) of FIG. 13. That is, the output signal 302B of the sheet sensor 140 becomes a continuous pulse signal in a case in which sheets are continuously fed.

When the output signal 302B of a continuous pulse signal is output from the sheet sensor 140, the blast control section 138 starts to measure a period that has elapsed from the sheet feeding timing by the timer 142 shown in FIG. 2 at a rising edge 302D of the first pulse 302C of the output signal 302B of a continuous pulse signal.

When a value measured by the timer 142 becomes $X_1$ seconds, the blast control section 138 sends a command signal 304, which is shown in (C) of FIG. 13 and indicates the start of an operation, to the blower unit 65. The blower unit 65 starts to operate at a rising edge 304A of the command signal 304.

When a value, which is measured by the timer 142 from a rising edge 302F of the last pulse 302E of the output signal 302B of a continuous pulse signal, becomes $X_2$ seconds, the blast control section 138 sends a command signal 306, which is shown in (D) of FIG. 13 and indicates the stop of an operation, to the blower unit 65. The blower unit 65 stops operating at a rising edge 306A of the command signal 306.

That is, in a case in which sheets are continuously fed, the blast control section 138 starts the operation of the blower unit 65 when $X_1$ seconds has passed from the sheet feeding timing of the first sheet S and stops the operation of the blower unit 65 when $X_2$ seconds has passed from the sheet feeding timing of the last sheet S.

[Description of Timing of Operation Start Command for Blower Unit]

FIG. 14 is a view illustrating the timing of an operation start command for the blower unit and the timing of an operation stop command for the blower unit, and schematically shows a part of the drawing section 18 and a part of the ink drying processing section 20. In FIG. 14, the same components as those of FIGS. 1 and 7 are denoted by the same reference numerals as those of FIGS. 1 and 7 and the description thereof will be omitted.

In FIG. 14, the liquid discharge heads 56C, 56M, 56Y, and 56K shown in FIGS. 1 and 7 are simplified without being individually shown and the structure of a part of the drawing section 18 is not shown. Reference numeral 320 of FIG. 14 denotes the sheet suction region of the drawing cylinder 52. Reference numeral 321 denotes a starting end of the sheet suction region 320 of the drawing cylinder 52, and reference numeral 322 denotes a terminus of the sheet suction region 320 of the drawing cylinder 52 and a starting end of the blast region of the blower unit 65.

Further, reference numeral 330 of FIG. 14 denotes a blast position of the blower unit 65, and reference numeral 71A denotes the starting end of the conveying guide 71. Reference numeral 340 denotes the blast region of the blower unit 65. The blast region 340 of the blower unit 65 includes a delivery position of the sheet S between the drawing cylinder 52 and the chain gripper 64.

A timing at which the operation start command is sent to the blower unit 65 is a blast region-reaching timing that is a timing at which a sheet S (not shown) passes through the sheet suction region 320 of the drawing cylinder 52 and reaches the blast region 340 of the blower unit 65.

A timing at which the front end SB of the sheet S reaches the starting end 322 of the blast region 340 of the blower unit 65, a timing at which the rear end SA of the sheet S reaches the starting end 322 of the blast region 340 of the blower unit 65, or a timing at which a part of the sheet S reaches the starting end 322 of the blast region 340 of the blower unit 65 is considered as the blast region-reaching timing.

FIG. 15A is a schematic diagram showing a timing at which the front end SB of the sheet S reaches the starting end 322 of the blast region 340 of the blower unit 65. FIG. 15B is a schematic diagram showing a timing at which the rear end SA of the sheet S reaches the starting end 322 of the blast region 340.

Further, FIG. 15C is a schematic diagram showing a timing at which a part of the sheet S reaches the starting end 322 of the blast region 340. For the simplification of drawings, the peripheral surface of the drawing cylinder 52 of FIGS. 15A, 15B, and FIG. 15C is shown so as to be spread out in the shape of a flat surface.

When the rear end SA of the sheet S passes through the terminus 322 of the sheet suction region 320 of the drawing cylinder 52 and the sheet S deviates from the sheet suction region 320 of the drawing cylinder 52 as shown in FIG. 15B, the suction force of the drawing cylinder 52 does not act on the sheet S. For this reason, there is a possibility that the falling of the sheet S may occur.

It is possible to prevent the falling of the sheet S, of which a part has passed through the sheet suction region 320 of the drawing cylinder 52, by sending the operation start command to the blower unit 65 at a timing, at which the front end SB of the sheet S reaches the starting end 322 of the blast region 340 of the blower unit 65 and which is shown in FIG. 15A, as the blast region-reaching timing in order to operate the blower unit 65.

When a timing at which the rear end SA of the sheet S reaches the starting end 322 of the blast region 340 of the blower unit 65 is applied as the blast region-reaching timing as shown in FIG. 15B, the start of the operation of the blower unit 65 can be delayed in comparison with a case in which a timing at which the front end SB of the sheet S reaches the starting end 322 of the blast region 340 of the blower unit 65 is applied as the blast region-reaching timing.

FIG. 16 is a view schematically showing the falling of a sheet S in a case in which the relatively thin sheet S is used. In FIG. 16, the same components as those of FIG. 14 are denoted by the same reference numerals as those of FIG. 14 and the description thereof will be appropriately omitted.

In a case in which the relatively thin sheet S shown in FIG. 16 is used, the rear end SA of the sheet S having passed through the starting end 322 of the blast region 340 of the blower unit 65 is turned over. For this reason, the turned portion of the sheet may come into contact with the in-line sensor 58 shown in FIGS. 1 and 2.

When a timing at which the rear end SA of the sheet S reaches the starting end 322 of the blast region 340 of the blower unit 65 is applied as the blast region-reaching timing, the turnover of the rear end SA of the sheet S shown in FIG. 16 can be prevented. Further, since the start of the operation of the blower unit 65 is delayed, the sending of the air from the blower unit 65 to the drawing section 18 is suppressed.

As shown in FIG. 15C, in a period having elapsed until the rear end SA of the sheet S passes through the blast region 340 of the blower unit 65 after the front end SB of the sheet S passes through the blast region 340 of the blower unit 65, the operation of the blower unit 65 can be started at a timing, at which the falling of the sheet S occurs, as the blast region-reaching timing.

FIG. 17 is a view schematically showing the falling of a sheet S in a case in which the relatively thick sheet S is used. In FIG. 17, the same components as those of FIGS. 14 and 16 are denoted by the same reference numerals as those of FIGS. 14 and 16 and the description thereof will be appropriately omitted.

In a case in which the relatively thick sheet S shown in FIG. 17 is used, the holding of the rear end SA of the sheet S performed by suction is released before the rear end SA of the sheet S passes through the starting end 322 of the blast region 340 of the blower unit 65. For this reason, the falling of the sheet S may occur.

Even when a sheet S having relatively high stiffness is used, the same falling of the sheet S may occur.

In a case in which a sheet S, which has a possibility that the falling may occur before the rear end SA of the sheet S passes through the starting end 322 of the blast region 340 of the blower unit 65, is used, the operation of the blower unit 65 should be started to prevent the falling of the sheet S until the falling of the sheet S occurs after the holding of the sheet S performed by the suction of the drawing cylinder 52 is released.

A timing at which the falling of the sheet S occurs can be obtained using a method, such as actual measurement or simulation. It is thought that a timing at which the falling of the sheet S occurs varies depending on the type of the sheet S or the conveying condition of the sheet S.

A timing at which the falling of the sheet S occurs is obtained for each of the type of the sheet S and the conveying condition of the sheet S, and the obtained timings at which the falling of the sheet S occurs are stored in association with the type of the sheet S and the conveying condition of the sheet S.

The type of the sheet S and the conveying condition of the sheet S are acquired and the stored timings at which the falling of the sheet S occurs are read, and the type of the sheet S, the conveying condition of the sheet S, and the stored timings can be used to control the start of the operation of the blower unit 65. Examples of the type of the sheet S include a thickness and a material. Examples of the conveying condition include a conveying speed.

The memory in which the timing at which the falling of the sheet S occurs is stored is included in the control system shown in FIG. 2.

[Description of Timing of Operation Stop Command for Blower Unit]

A timing at which the operation stop command is sent to the blower unit 65 is a blast region-pass timing that is a timing at which a sheet S passes through the blast region 340 of the blower unit 65. The blast region 340 of the blower unit 65 is a region between the terminus 322 of the sheet suction region 320 of the drawing cylinder 52 and the starting end 71A of the conveying guide 71.

A timing until the rear end SA of the sheet S reaches the blast position 330 after the rear end SA of the sheet S passes through the terminus 322 of the sheet suction region of the drawing cylinder 52, which is a timing at which the falling of the sheet S or the like does not occur, a blast position-pass timing, which is a timing at which the rear end SA of the sheet S passes through the blast position 330, or a conveying guide-pass timing, which is a timing at which the rear end SA of the sheet S passes through the starting end 71A of the conveying guide 71, is considered as the blast region-pass timing. The fact that the falling of the sheet S does not occur means that the shape of the sheet S is maintained during the conveyance of the sheet S.

FIG. 18A is a schematic diagram showing an arbitrary timing until the rear end SA of the sheet S reaches the blast position 330 after the rear end SA of the sheet S passes through the terminus 322 of the sheet suction region of the drawing cylinder 52.

FIG. 18B is a schematic diagram showing a timing at which the rear end SA of the sheet S passes through the blast position 330 of the blower unit 65. Further, FIG. 18C is a schematic diagram showing a timing at which the rear end SA of the sheet S passes through the starting end 71A of the conveying guide 71. In FIGS. 18A to 18C, the same components as those of FIGS. 15A to 15C are denoted by the same reference numerals as those of FIGS. 15A to 15C and the description thereof will be appropriately omitted.

The peripheral surface of the drawing cylinder 52, the surface of the conveying guide 71 supporting the sheet S, and the conveying path of the sheet S, which is shown by a broken line and reaches the conveying guide 71 from the drawing cylinder 52, are shown in FIGS. 18A to 18C so as to be spread out in the shape of a flat surface.

There is a possibility that the falling of the sheet S may occur in a case in which the rear end SA of the sheet S is positioned between the terminus 322 of the sheet suction region 320 of the drawing cylinder 52 and the blast position 330 of the blower unit 65. Accordingly, when the operation of the blower unit 65 is stopped at a timing at which the rear end SA of the sheet S passes through the terminus 322 of the sheet suction region of the drawing cylinder 52, the rear end SA of the sheet S does not yet reach the blast position 330 of the blower unit 65, and the falling of the sheet S does not occur, as the blast region-pass timing, the sending of the air from the blower unit 65 to the drawing section 18 is suppressed while the falling of the sheet S is prevented.

A timing at which the falling of the sheet S does not occur can be obtained using a method, such as actual measurement or simulation. It is thought that a timing at which the falling of the sheet S does not occur varies depending on the type of the sheet S or the conveying condition of the sheet S.

A timing at which the falling of the sheet S does not occur is obtained for each of the type of the sheet S and the conveying condition of the sheet S, and the obtained timings at which the falling of the sheet S does not occur are stored in association with the type of the sheet S and the conveying condition of the sheet S.

Further, a timing at which the falling of the sheet S does not occur, which is obtained when the operation start timing of the blower unit 65 is derived and corresponds to each of the type of the sheet S and the conveying condition of the sheet S, can also be used.

When the rear end SA of the sheet S passes through the blast position 330 of the blower unit 65 as shown in FIG. 18B, the falling of the sheet S does not occur. Accordingly, it is possible to reliably prevent the falling of the sheet S by sending the operation stop command to the blower unit 65 at a timing, at which the rear end SA of the sheet S passes through the blast position 330 of the blower unit 65, as the blast region-pass timing in order to stop the operation of the blower unit 65.

When a timing at which the rear end SA of the sheet S passes through the blast position 330 of the blower unit 65 is applied as the blast region-pass timing, a timing at which the operation of the blower unit 65 is stopped is delayed in comparison with a case in which a timing at which the rear end SA of the sheet S passes through the terminus 322 of the sheet suction region of the drawing cylinder 52, the rear end SA of the sheet S does not yet reach the blast position 330 of the blower unit 65, and the falling of the sheet S does not occur is applied as the blast region-pass timing. Accordingly, an effect of suppressing the sending of the air from the blower unit 65 to the drawing section 18 is reduced.

Accordingly, it is preferable that a timing at which the rear end SA of the sheet S passes through the blast position 330 of the blower unit 65 is applied as the blast region-pass timing in a case in which a sheet S of which the falling does not easily occur is used, a case in which the processing temperature of the ink drying processing section 20 is relatively low, and the like.

It is possible to reliably prevent the falling of the sheet S by applying a timing, at which the rear end SA of the sheet S has passed through the starting end 71A of the conveying guide 71, as the blast region-pass timing as shown in FIG. 18C.

In this embodiment, the blast region-reaching timing, which is the operation start timing of the blower unit 65, has been derived on the basis of the pass of the rear end SA of the sheet S and a period $X_1$ having elapsed until the start of the operation of the blower unit 65 from the sheet feeding timing of the sheet S has been derived; and the operation stop timing of the blower unit 65 has been derived on the basis of the pass of the rear end SA of the sheet S and a period $X_2$ having elapsed until the stop of the operation of the blower unit 65 from the sheet feeding timing of the sheet S has been derived. The invention is not limited to this embodiment, and a period $X_1$, which has elapsed until the start of the operation of the blower unit 65 from the sheet feeding timing of the sheet S, and a period $X_2$, which has elapsed until the stop of the operation of the blower unit 65 from the sheet feeding timing of the sheet S, may be derived on the basis of the front end SB of the sheet S.

That is, a timing at which the front end SB of the sheet S passes through the sheet suction region 320 of the drawing cylinder 52, a timing at which the front end SB of the sheet S passes through the blast position 330 of the blower unit 65, and a timing at which the front end SB of the sheet S passes through the starting end 71A of the conveying guide 71 are constant regardless of the length of the sheet S in the conveying direction Y of the sheet S if the conveying speed of the sheet S is constant.

A timing at which the sheet S passes through the sheet suction region 320 of the drawing cylinder 52, a timing at which the sheet S passes through the blast position 330 of the blower unit 65, and a timing at which the sheet S passes through the starting end 71A of the conveying guide 71 may be based on the front end SB of the sheet S and may be based on the rear end SA of the sheet S.

[Description of Flow of Operation Control of the Blower Unit]

FIG. 19 is a flowchart illustrating the flow of the operation control of the blower unit 65. After the operation control of the blower unit 65 is started in Step S10, the adjustment of temperature is started in a temperature-adjustment starting step of Step S11. Further, it is determined in a sheet-feeding detecting step of Step S12 whether or not the feeding of a sheet has been detected.

The detection of the feeding of a sheet is continued in the case of the determination of "No" in which it is determined in the sheet-feeding detecting step that the feeding of a sheet has not been detected. On the other hand, the flow of the operation control proceeds to a measurement step of Step S14 in the case of the determination of "Yes" in which it is determined in the sheet-feeding detecting step that the feeding of a sheet has been detected.

The period having elapsed from the sheet feeding timing is measured in the measurement step. After the period having elapsed from the sheet feeding timing is measured, the flow of the operation control proceeds to a first elapsed period determining step of Step S16. It is monitored in the first elapsed period determining step whether or not $X_1$ seconds has elapsed from the sheet feeding timing.

The monitoring of whether or not $X_1$ seconds has elapsed from the sheet feeding timing is continued in the case of the determination of "No" in which it is determined in the first elapsed period monitoring step that $X_1$ seconds has not elapsed from the sheet feeding timing. On the other hand, the flow of the operation control proceeds to an operation-start-command sending step of Step S18 in the case of the determination of "Yes" in which it is determined in the first elapsed period monitoring step that $X_1$ seconds has elapsed from the sheet feeding timing.

The command signal 304, which is shown in (C) of FIG. 12 and (C) of FIG. 13 and indicates the start of the operation, is sent to the blower unit 65 from the blast control section 138 shown in FIG. 2 in the operation-start-command sending step, and the flow of the operation control proceeds to a subsequent-sheet-feeding determining step of Step S20 of FIG. 19.

It is determined in the subsequent-sheet-feeding determining step whether or not sheets are subsequently fed, that is, whether or not sheets are continuously fed. The flow of the operation control returns to Step S12 in the case of the determination of "No" in which it is determined in the subsequent-sheet-feeding determining step that sheets are subsequently fed, and the monitoring of the sheet feeding timing is continued.

In a case in which sheets are continuously fed, the first elapsed period determining step of Step S16 and the operation-start-command sending step of Step S18 will be omitted for the second and subsequent sheets S.

On the other hand, the flow of the operation control proceeds to a second elapsed period determining step of Step S22 in the case of the determination of "Yes" in which it is determined in the subsequent-sheet-feeding determining step that sheets are not subsequently fed. It is determined in the second elapsed period determining step whether or not $X_2$ seconds has elapsed from the detection of the feeding of the last sheet.

The monitoring of whether or not $X_2$ seconds has elapsed from the last sheet feeding timing is continued in the case of the determination of "No" in which it is determined in the second elapsed period determining step that $X_2$ seconds has not elapsed from the last sheet feeding timing.

On the other hand, the flow of the operation control proceeds to an operation-stop-command sending step of Step S24 in the case of the determination of "Yes" in which it is determined in the second elapsed period determining step that $X_2$ seconds has elapsed from the last sheet feeding timing.

The command signal 306, which is shown in (D) of FIG. 12 and (D) of FIG. 13 and indicates the stop of the operation, is sent to the blower unit 65 from the blast control section 138 shown in FIG. 2 in the operation-stop-command sending step, the flow of the operation control proceeds to a temperature-adjustment stopping step of Step S25 of FIG. 19 and further proceeds to an end step of Step S26, and the operation control of the blower unit 65 is ended.

In FIG. 19, the flow of the operation control, which is performed from the temperature adjustment start of Step S11 to the temperature adjustment stop of Step S25, functions as a temperature adjusting step. The temperature adjusting step may be performed independently of the operation control of the blower unit 65.

The flow of the operation control, which is performed from the operation-start-command sending of Step S18 to the operation-stop-command sending of Step S24, functions as a blast step of sending the air to a medium to be conveyed. Further, the measurement step of Step S14 functions as a blast region-pass-timing deriving step of deriving a blast region-pass timing at which the medium passes through the blast region where the air is sent to the medium.

In addition, the operation control of the blower unit 65 of which the flowchart is shown in FIG. 19 can be applied to a medium conveying method of conveying a medium to which liquid discharged from liquid discharge heads is to be applied.

[Description of Table Used for Operation Control of Blower Unit]

FIG. 20 is a diagram illustrating examples of the structure of tables that are applied to the operation control of the blower unit 65.

A period $X_1$ having elapsed until the start of the operation of the blower unit 65 from the sheet feeding timing of the sheet S and a period $X_2$ having elapsed until the stop of the operation of the blower unit 65 from the last sheet feeding timing are derived in advance while the type of the sheet S, the conveying condition of the sheet S, and the drying processing condition of the ink drying processing section 20 are used as parameters. Then, the period $X_1$ and the period $X_2$ are stored in the tables shown in FIG. 20. The period $X_1$ having elapsed until the start of the operation of the blower unit 65 from the sheet feeding timing and the period $X_2$ having elapsed until the stop of the operation of the blower unit 65 from the last sheet feeding timing, which correspond to at least one of the type of the sheet S, the conveying condition of the sheet S, or the drying processing condition of the ink drying processing section 20, are read from the tables shown in FIG. 20 and can be applied to the operation control of the blower unit 65.

The tables shown in FIG. 20 can be stored in the parameter storage section 134 shown in FIG. 2.

[Other Form of Operation Control of Blower Unit]

An aspect in which an operation stop command is sent to the blower unit 65 at a timing at which the sheet S passes through the blast region 340 of the blower unit 65 has been illustrated in this embodiment. The invention is not limited to this aspect, and the sending of the air, which is sent from the blower unit 65, to the surrounding area of the liquid discharge heads 56C, 56M, 56Y, and 56K may be suppressed by the reduction of the amount of the air sent from the blower unit 65 without the stop of the sending of the air from the blower unit 65.

For example, processing, such as processing for reducing a voltage to be applied to the air blower 65D of the blower unit 65 or processing for reducing on-duty by using a pulse voltage as a voltage to be applied to the air blower 65D, can be applied. A reduction ratio of the amount of the air from the standard amount of the air sent from the blower unit 65 can be obtained using a method, such as actual measurement or simulation, in consideration of the state of dew condensation, temperature, and the like on the discharge surfaces of the liquid discharge heads 56C, 56M, 56Y, and 56K.

An aspect in which the amount of the air sent from the blower unit 65 is reduced without the stop of the sending of the air from the blower unit 65 is effective in a case in which the operation of the blower unit 65 cannot be instantly stopped due to the characteristics of the blower unit 65 when an operation stop command is sent to the blower unit 65, a case in which the operation of the blower unit 65 cannot be stopped in consideration of the durability of the blower unit 65 when an operation stop command is sent to the blower unit 65, and the like.

According to the liquid discharge apparatus having the above-mentioned structure and a method of conveying a medium, the liquid discharge apparatus, which includes the blower unit 65 for sending the air to the sheet delivery region 59 between the drawing cylinder 52 and the chain gripper 64 in order to prevent the falling of a sheet S when the sheet S is delivered to the chain gripper 64 from the drawing cylinder 52, derives a blast region-pass timing at which the sheet S passes through the blast region of the blower unit 65 and sends an operation stop command signal to the blower unit 65 at the blast region-pass timing to stop the operation of the blower unit 65.

Since the transport of the air, which is present around the ink drying processing units 68 disposed on the downstream side of the blower unit 65 in the conveying direction Y of the sheet S, to the drawing section 18 is suppressed, dew condensation on the discharge surfaces of the liquid discharge heads 56C, 56M, 56Y, and 56K of the drawing section 18 is prevented. As a result, good liquid discharge is achieved. The surrounding area of the ink drying processing units 68, which function as the temperature adjusting section, is a region which is affected by drying processing temperature and of which the temperature is higher than temperature in a state in which the ink drying processing units 68 stop operating.

Particularly, even though the air present around the ink drying processing section 20 is insufficiently isolated from the air present around the liquid discharge heads 56C, 56M, 56Y, and 56K in a case in which the air present around the ink drying processing section 20 is isolated from the air present around the liquid discharge heads 56C, 56M, 56Y, and 56K by the isolation plate 66, which is shown in FIG. 1, or the like, the transport of the air, which is present around the ink drying processing section 20, to the surrounding area of the discharge surfaces of the liquid discharge heads 56C, 56M, 56Y, and 56K can be suppressed.

Further, a blast region-reaching timing at which the sheet S passes through the terminus 322 of the sheet suction region 320 of the drawing cylinder 52 is derived, and an operation start command is sent to the blower unit 65 at the blast region-reaching timing in order to operate the blower unit 65. Accordingly, since the falling of the sheet S, which is caused by the action of the air sent from the blower unit 65 when the sheet S is delivered to the chain gripper 64 from the drawing cylinder 52, is prevented, the contact between the sheet S and other components of the apparatus is prevented.

In a case in which sheets are continuously fed, a timing at which the first sheet S passes through the terminus 322 of the sheet suction region 320 of the drawing cylinder 52 is applied as the blast region-reaching timing and a timing at which the last sheet S passes through the blast region is applied as the blast region-pass timing. Accordingly, even in a case in which sheets are continuously fed, the sending of the air from the blower unit 65 to the drawing section 18 is suppressed and the falling of the sheet S, which is caused when the sheet S is delivered to the chain gripper 64 from the drawing cylinder 52, is prevented.

An aspect in which the sheet S is conveyed downward from the upper side in the vertical direction when the sheet S is delivered to the chain gripper 64 from the drawing cylinder 52 has been illustrated in this embodiment, but the operation control of the blower unit 65 illustrated in this embodiment can also be applied to an aspect in which the sheet is conveyed upward from the lower side in the vertical direction.

A paper medium has been illustrated as the sheet S in this embodiment, but a sheet-like medium, such as a resin sheet or a metal sheet, other than a paper medium can be applied as the sheet S.

The ink jet recording apparatus, which uses treatment liquid for flocculating or insolubilizing ink, has been illustrated in this embodiment, but the operation control of the blower unit 65 described in this embodiment can also be applied to the form in which the treatment liquid applying section 14 and the treatment liquid drying processing unit 50 are omitted.

First Modification Example

FIG. 21 is a view showing the schematic overall configuration of an ink jet recording apparatus 400 according to a first modification example. The ink jet recording apparatus 400 includes a drawing section 418 that includes liquid discharge heads 456C, 456M, 456Y, and 456K for discharging ink droplets to a sheet S held by the suction of a sheet conveying unit 452.

In FIG. 21, the liquid discharge heads 456C, 456M, 456Y, and 456K are collectively shown without being individually shown.

The sheet conveying unit 452 includes a conveying belt 452C that is wound around a driving roller 452A and a driven roller 452B. A sheet suction unit 420, which holds a sheet S conveyed by the sheet conveying unit 452 by suction, is disposed immediately below the drawing section 418.

The sheet suction unit 420 includes suction holes (not shown) that are formed in the conveying belt 452C, a chamber 420A that communicates with the suction holes, a suction flow passage 420B that communicates with the chamber 420A, and a pump 420C that is provided on the suction flow passage 420B.

Negative pressure is generated in the chamber 420A by the operation of the pump 420C. Since the negative pressure, which is generated in the chamber 420A, acts on the sheet S through the suction holes (not shown), the sheet S is held on the conveying belt 452C by suction.

A blower unit 465, which sends the air to the sheet S conveyed by the sheet conveying unit 452, is disposed on the downstream side of the drawing section 418 in a conveying direction Y of the sheet S. Since the air is sent to the sheet S from the blower unit 465, the turnover of a front end SB and a rear end SA of the sheet S is prevented.

Reference numeral 421 of FIG. 21 denotes the starting end of a sheet suction region in which the suction of the sheet S is performed by the sheet suction unit 420, and reference numeral 422 denotes the terminus of the sheet suction region and the starting end of a blast region 440 of the blower unit 465.

A temperature adjusting section 468 is disposed on the downstream side of the blower unit 465 in the conveying direction Y of the sheet S. The direction of the air sent from the blower unit 465 shown in FIG. 21 is a downward direction toward the surface of the conveying belt 452C that supports the sheet S. Temperature adjustment processing includes drying processing or cooling processing.

The same operation control as the operation control of the blower unit 65 of the above-described embodiment is applied to the blower unit 465 shown in FIG. 21. An operation start command is sent to the blower unit 465 at a blast region-reaching timing at which the sheet S reaches the blast region 440 of the blower unit 465. Further, an operation stop command or an air reduction command is sent to the blower unit 465 at a blast region-pass timing at which the sheet S passes through the blast region 440 of the blower unit 465.

An operation stop command is sent to the blower unit 465 in response to the pass of the sheet S passing through the blast region 440 of the blower unit 465 in order to stop the operation of the blower unit 465. Alternatively, an air reduction command is sent to the blower unit 465 in response to the pass of the sheet S passing through the blast region 440 of the blower unit 465 in order to reduce the amount of the air sent from the blower unit 465. Accordingly, the sending of the air, which is present around the temperature adjusting section 468, to the drawing section 418 is prevented by the air sent from the blower unit 465.

FIG. 22 is a plan view showing the arrangement of the drawing section 418, the blower unit 465, and the temperature adjusting section 468 of the ink jet recording apparatus 400 shown in FIG. 21 and showing the ink jet recording apparatus 400 from the upper side of the liquid discharge heads 456C, 456M, 456Y, and 456K.

FIG. 23 is a plan view showing another example of the arrangement of the drawing section 418, the blower unit 465, and the temperature adjusting section 468 and showing an ink jet recording apparatus 400A from the upper side of the liquid discharge heads 456C, 456M, 456Y, and 456K. A sheet S is not shown in FIGS. 22 and 23.

As shown in FIG. 23, the blower unit 465 and the temperature adjusting section 468 are arranged at a position deviating from the conveying path of the sheet S. The position deviating from the conveying path of the sheet S includes a position that deviates from the conveying belt 452C, and a position which is present on the conveying belt 452C and where the sheet S is not held and the sheet S does not pass.

The arrangement relationship of the blower unit 465 and the temperature adjusting section 468 shown in FIG. 23 in the conveying direction Y of the sheet S is maintained, and the blower unit 465 and the temperature adjusting section 468 are arranged on the lateral side, which deviates from the conveying path of the sheet S, of the conveying belt 452C. The direction of the air sent from the blower unit 465 of FIG. 23 is shown by an arrow without reference numeral.

According to the above-described first modification example, the sending of the air from the blower unit 465 to the surrounding area of the discharge surfaces of the liquid discharge heads 456C, 456M, 456Y, and 456K is suppressed and the turnover of the sheet S is prevented by the air sent from the blower unit 465.

Second Modification Example

FIG. 24 is a view showing the schematic overall configuration of an ink jet recording apparatus 500 according to a second modification example. FIG. 25 is a plan view showing the arrangement of a drawing section 418, a blower unit 565, and a temperature adjusting section 568 of the ink jet recording apparatus 500 shown in FIG. 24 and showing the ink jet recording apparatus 500 from the upper side of liquid discharge heads 456C, 456M, 456Y, and 456K.

FIG. 26 is a plan view showing another example of the arrangement of the drawing section 418, the blower unit 565, and the temperature adjusting section 568 and showing an ink jet recording apparatus 500A from the upper side of the liquid discharge heads 456C, 456M, 456Y, and 456K. In FIGS. 24 to 26, the same components as those of FIGS. 21, 22, and 23 are denoted by the same reference numerals as those of FIGS. 21, 22, and 23 and the description thereof will be appropriately omitted. Further, a sheet S is not shown in FIGS. 25 and 26.

Reference numeral 521 of FIGS. 24 to 26 denotes the terminus of a blast region 540 of the blower unit 565. Furthermore, the direction of the air sent from the blower unit 565 of FIG. 26 is shown by an arrow without reference numeral.

The blower unit 565 and the temperature adjusting section 568 shown in FIGS. 24 to 26 are disposed on the upstream side of the liquid discharge heads 456C, 456M, 456Y, and 456K in the conveying direction Y of the sheet S. Further, the temperature adjusting section 568 is disposed on the upstream side of the blower unit 565 in the conveying direction Y of the sheet S. That is, the temperature adjusting section 568 is disposed on the side of the blower unit 565 opposite to the liquid discharge heads 456C, 456M, 456Y, and 456K in the conveying direction Y of the sheet S.

An operation stop command or an air reduction command is sent to the blower unit 565 shown in FIGS. 24 to 26 at a timing at which the sheet passes through the blast region 540 of the blower unit 565. When the operation of the blower unit 565 is stopped or the amount of the air sent from the blower unit 565 is reduced, the sending of the air, which is present around the temperature adjusting section 568, to the discharge surfaces of the liquid discharge heads 456C, 456M, 456Y, and 456K is suppressed by the air sent from the blower unit 565.

Further, since the operation start command is sent to the blower unit 565 at a timing at which the sheet S passes through a starting end 522 of the blast region 540 of the blower unit, the turnover of the sheet S is prevented when the sheet S enters the liquid discharge regions of the liquid discharge heads 456C, 456M, 456Y, and 456K.

According to the ink jet recording apparatuses 400 and 400A of the first modification example and the ink jet recording apparatuses 500 and 500A of the second modification example, the operation control of the blower unit 65 of the above-described embodiment can also be applied to a structure in which a sheet S is horizontally conveyed and a structure in which a sheet S is not delivered between the drawing and the temperature adjustment processing.

Further, as shown in FIGS. 23 and 26, the operation control of the blower unit 65 of the above-described embodiment can also be applied to a structure in which the blower units 465 and 565 and the temperature adjusting sections 468 and 568 are arranged at the position deviating from the conveying path of the sheet S.

In the first and second modification examples, the conveying belt 452C may be provided with a gripper that grips one end of the sheet S, for example, the front end SB of the sheet S shown in FIG. 21.

The operation control of the blower unit has been described in this embodiment and the first and second modification examples, but the operation control of the blower unit may be applied to the operation control of means for sending the air, such as the treatment liquid drying cylinder blower unit 51 shown in FIG. 1. According to such an aspect, the sending of the air, which is present around the treatment liquid drying processing unit 50, to the surrounding area of the treatment liquid applying device 44 is suppressed. Accordingly, a change in environment around the treatment liquid applying device 44 is suppressed.

The liquid discharge apparatus and the method of conveying a medium, which have been described above, may be appropriately subjected to modification, addition, and removal without departing from the scope of the invention. Further, the above-mentioned embodiments may be appropriately combined.

EXPLANATION OF REFERENCES

10, 400, 500: ink jet recording apparatus
52: drawing cylinder
56C, 56M, 56Y, 56K, 456C, 456M, 456Y, 456K: liquid discharge head
64: chain gripper
65, 465, 565: blower unit
68: ink drying processing unit
138: blast control section
140: sheet sensor
142: timer
452, 525: sheet conveying unit
468, 568: temperature adjusting section
S: sheet

What is claimed is:

1. A liquid discharge apparatus comprising:

a liquid discharge head that discharges liquid;

a conveying section that supports and conveys a medium to which the liquid discharged from the liquid discharge head is to be applied;

a blower unit that is disposed on the upstream side of the liquid discharge head in a medium conveying direction or the downstream side of the liquid discharge head in the medium conveying direction, and suppresses the change of the posture of the medium by sending the air to the medium conveyed by the conveying section;

a temperature adjusting section that is disposed on the upstream side of the blower unit in the medium conveying direction in a case in which the blower unit is disposed on the upstream side of the liquid discharge head in the medium conveying direction or is disposed on the downstream side of the blower unit in the medium conveying direction in a case in which the blower unit is disposed on the downstream side of the liquid discharge head in the medium conveying direction, and adjusts the temperature of an object, of which the temperature is to be adjusted, to a temperature higher than the ambient temperature of the liquid discharge head or a temperature lower than the ambient temperature of a discharge surface of the liquid discharge head; and a blast control section that controls the operation of the blower unit, wherein the blast control section sends an operation stop command, which stops an operation, or an air reduction command, which reduces the amount of the air to be sent, to the blower unit at a blast region-pass timing at which the medium, to which the air is sent from the blower unit, passes through a blast region of the blower unit.

2. The liquid discharge apparatus according to claim 1, wherein in a case in which a plurality of media are continuously conveyed, the blast control section applies a timing, at which the last medium of the plurality of media passes through the blast region of the blower unit, as the blast region-pass timing.

3. The liquid discharge apparatus according to claim 2, wherein the blast control section applies a timing, at which a rear end of the medium to which the air is sent from the blower unit passes through the blast region, as the blast region-pass timing.

4. The liquid discharge apparatus according to claim 1, wherein the blast control section applies a timing, at which a rear end of the medium to which the air is sent from the blower unit passes through the blast region, as the blast region-pass timing.

5. The liquid discharge apparatus according to claim 1, wherein the blast control section applies a timing, at which a rear end of the medium to which the air is sent from the blower unit passes through a blast position of the blower unit, as the blast region-pass timing.

6. The liquid discharge apparatus according to claim 1, wherein the blast control section applies a timing, at which a part of the medium to which the air is sent from the blower unit passes through the blast region and the previously obtained shape of the medium during the conveyance of the medium is maintained, as the blast region-pass timing.

7. The liquid discharge apparatus according to claim 1, wherein the blast control section sends an operation start command to the blower unit at a blast region-reaching timing at which the medium to which the air is sent from the blower unit reaches the blast region of the blower unit.

8. The liquid discharge apparatus according to claim 7, wherein the blast control section sends an operation start command to the blower unit at a blast region-reaching timing at which a front end of the medium to which the air is sent from the blower unit reaches the blast region of the blower unit.

9. The liquid discharge apparatus according to claim 7, wherein the blast control section sends an operation start command to the blower unit at a blast region-reaching timing at which a rear end of the medium to which the air is sent from the blower unit reaches the blast region of the blower unit.

10. The liquid discharge apparatus according to claim 7, wherein the blast control section sends an operation start command to the blower unit at a blast region-reaching timing that is a timing at which a part of the medium to which the air is sent from the blower unit reaches the blast region of the blower unit and the previously obtained shape of the medium during the conveyance of the medium is not maintained.

11. The liquid discharge apparatus according to claim 1, wherein in a case in which a plurality of media are continuously conveyed, the blast control section applies a timing, at which the last medium of the plurality of media pass through the blast region of the blower unit, as the blast region-pass timing.

12. The liquid discharge apparatus according to claim 1, wherein the conveying section comprises a gripping part that grips one end of the medium conveyed by the conveying section to fix the medium.

13. The liquid discharge apparatus according to claim 1, wherein the conveying section comprises a suction-fixing unit that sucks the surface of the medium, which is opposite to the surface of the medium to which the liquid discharged from the liquid discharge head is to be applied, to fix the medium.

14. The liquid discharge apparatus according to claim 1, wherein the conveying section comprises a first conveying unit and a second conveying unit that is disposed on the downstream side of the first conveying unit in the conveying direction, and the blower unit is disposed at a position where a medium delivery region in which a medium is delivered to the second conveying unit from the first conveying unit is included in the blast region of the blower unit.

15. The liquid discharge apparatus according to claim 14, wherein the liquid discharge head is disposed on a conveying path of a medium conveyed by the first conveying unit, and the temperature adjusting section is disposed at a position where the temperature adjusting section adjusts the temperature of the medium conveyed by the second conveying unit.

16. The liquid discharge apparatus according to claim 14, wherein the second conveying unit is disposed at a position where the conveying path of a medium of the second conveying unit is different from the conveying path of a medium of the first conveying unit in a vertical direction.

17. The liquid discharge apparatus according to claim 14, wherein the first conveying unit is an impression cylinder that has a cylindrical shape, supports a medium by an outer peripheral surface thereof, and rotates and conveys the medium, comprises a first gripping part that grips one end of the medium to fix the medium, and includes a conveying path along which the medium is conveyed to the lower side in the vertical direction from the upper side in the vertical direction at a delivery position of the medium between itself and the second conveying unit.

18. The liquid discharge apparatus according to claim 14, wherein the second conveying unit comprises a second gripping part that grips at least one end of the medium conveyed by the second conveying unit to fix the medium, and the blower unit is disposed at a position where the blower unit sends the air to the first conveying unit from the second conveying unit.

19. The liquid discharge apparatus according to claim 14, wherein the temperature adjusting section includes a drying processing section that dries the medium to which the liquid discharged from the liquid discharge head is applied and performs processing for drying the medium conveyed by the second conveying unit.

20. A method of conveying a medium to which liquid discharged from a liquid discharge head, which discharges liquid, is to be applied, the method comprising:

a blast step of sending air to the medium to be conveyed from the upstream side of the liquid discharge head in a medium conveying direction or the downstream side of the liquid discharge head in the medium conveying direction; and a temperature adjusting step of adjusting the temperature of an object, of which the temperature is to be adjusted, to a temperature higher than the ambient temperature of the liquid discharge head or a temperature lower than the ambient temperature of the liquid discharge head on the upstream side of the sending of the air in the medium conveying direction in a case in which the air is sent from the upstream side of the liquid discharge head in the medium conveying direction or on the downstream side of the sending of the air in the medium conveying direction in a case in which the air is sent from the downstream side of the liquid discharge head in the medium conveying direction, wherein in the blast step, a blast stop command for stopping the sending of the air or an air reduction command for reducing the amount of the air to be sent is generated at a blast region-pass timing at which the medium to which the air is sent passes through a blast region.

* * * * *